US005474293A

United States Patent [19]

Tanaka

[11] Patent Number: 5,474,293

[45] Date of Patent: Dec. 12, 1995

[54] GLIDING OBJECT FOR GAME OF CURLING

[75] Inventor: Koichi Tanaka, Nagoya, Japan

[73] Assignee: Chubu Bearing Kabushiki Kaisha, Nagoya, Japan

[21] Appl. No.: 441,675

[22] Filed: May 15, 1995

Related U.S. Application Data

[63] Continuation of Ser. No. 225,174, Apr. 8, 1994, abandoned.

[30] Foreign Application Priority Data

Apr. 15, 1993 [JP] Japan ..... 5-113828
Sep. 1, 1993 [JP] Japan ..... 5-241970

[51] Int. Cl.[6] ..... A63B 67/14

[52] U.S. Cl. ..... 273/128 CS

[58] Field of Search ..... 273/128 R, 128 A, 273/128 CS, 126 R, 126 A

[56] References Cited

U.S. PATENT DOCUMENTS

| | | | |
|---|---|---|---|
| 517,103 | 3/1894 | Hamilton | 273/128 CS |
| 1,772,804 | 8/1930 | Gillis | 273/128 CS |
| 2,133,423 | 10/1938 | Burrow | 273/128 CS |
| 2,462,436 | 2/1949 | Stewart | 273/128 CS |
| 4,218,062 | 8/1980 | Brooks, Jr. | 273/128 R X |

FOREIGN PATENT DOCUMENTS

| | | | |
|---|---|---|---|
| 961877 | 1/1975 | Canada | 273/128 CS |
| 2251884 | 4/1974 | Germany | 273/128 CS |
| 15383 | 11/1887 | United Kingdom | 273/128 CS |
| 18631 | of 1908 | United Kingdom | 273/128 CS |
| 29130 | of 1912 | United Kingdom | 273/128 CS |
| 228395 | 2/1925 | United Kingdom . | |
| 230985 | 3/1925 | United Kingdom | 273/128 CS |
| 958476 | 5/1964 | United Kingdom . | |

*Primary Examiner*—Raleigh W. Chiu
*Attorney, Agent, or Firm*—Flynn, Thiel, Boutell & Tanis

[57] ABSTRACT

A gliding object as recreational sporting goods comprises a body, hollows which are formed at the front and rear of the bottom of the body, rolling members which are detachably fixed in the hollows, and wheel members which are equipped in the rolling members.

20 Claims, 46 Drawing Sheets

GLIDING OBJECT FOR GAME OF CURLING

This application is a continuation of U.S. Ser. No. 08/225,174, filed Apr. 8, 1994 now abandoned.

BACKGROUND OF THE INVENTION

1. Field of the Invention

The present invention relates to an improved gliding object for use as recreational sporting goods which enable players to play a game like curling with simple goods in simple facilities without a vast ice rink.

2. Prior Art

Curling is a well-known ice sport. A player throws a discal stone whose weight is about 20 kilograms at a tee (concentric circles) on an ice rink which is 4.3 meters in width and 49.5 meters in length, while other players sweep with brooms a course through which the stone glides in order to regulate the gliding speed. But curling has some troubles and shortcomings. It requires a vast ice rink, and therefore it cannot be played easily. It is impossible to promote the spread of curling because sweeping is a heavy exercise and it is also impossible to regulate the gliding direction of a stone.

To overcome the above shortcomings, the UNICURL was invented in Sweden, which is a recreational game for players to enjoy by gliding stones on a carpet. But it has shortcomings such as a necessity of a wax. That is, it is necessary to wax the upper face of a carpet beforehand in order to enable a stone to glide smoothly and players' clothes and stones are often stained with wax.

SUMMARY OF THE INVENTION

It is therefore an object of the present invention to provide a gliding object for use as recreational sporting goods which enable players to play easily without great physical strength, preparation and formal facilities which curling, the UNICURL and other recreational games require. With the present invention, gliding parts are standardized so that it is possible to exchange them quickly, regulate the gliding direction of stones, and play games smoothly.

To overcome the aforementioned shortcomings, such as the necessity of a vast ice rink and extensive physical training in the case of curling, the trouble related to the preparation and staining of players' clothes with a wax in the case of the UNICURL, or the difficulty in regulating the gliding direction of stones, a gliding object used as recreational sporting goods and constructed according to the present invention enables players to play games smoothly because: common rolling members, which are arranged at the bottom of a body, are detachable. In addition, a tire of a rolling member is freely banked on both sides; a wheel member is moved to the right or left side; and the starting pitch of a wheel member is suitably varied. As a result, players can easily select a suitable throwing course.

Furthermore, a gliding object used as recreational sporting goods comprises a body, a handle which is fixed to the upper portion of the body, and rolling members which are equipped at the front and rear of the bottom of the body.

The rolling members, which have wheel members mounted in cassettes, are detachably fixed at the body. In the case of the three-wheel form, a tire of a wheel member of a rolling member apart from two side rolling members is freely banked to both sides. And it is possible to move the center of a wheel member to the right or left side of the center line between two side wheel members, and to vary the starting pitch of a wheel member suitably.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENT

A gliding object for use as recreational sporting goods constructed according to the present invention will be described with reference to FIGS. 1 to 49.

Figure 1:
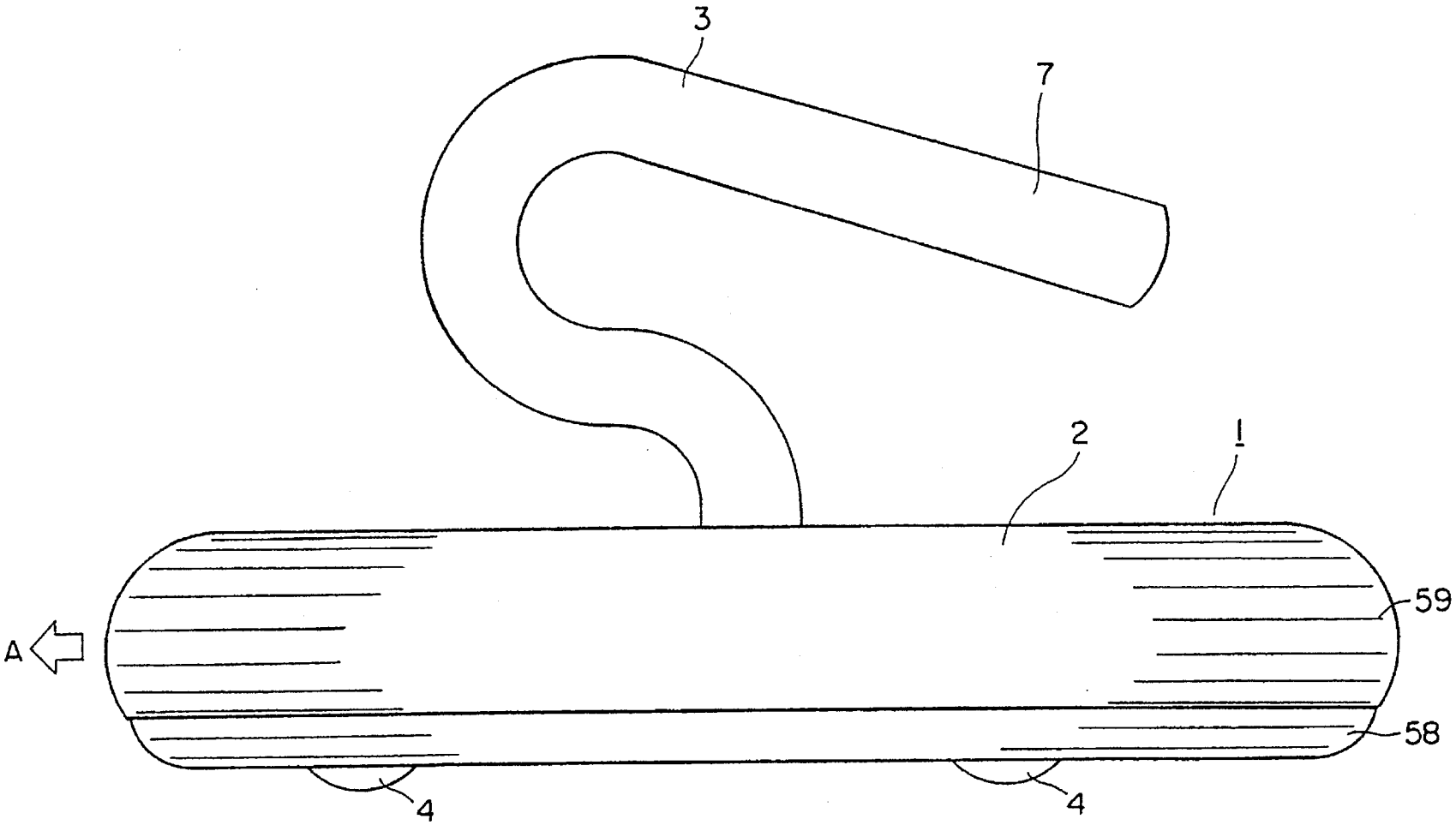
FIG. 1 is a side view of a gliding object for use as recreational sporting goods which is constructed by unifying upper and lower sections according to the present invention.
Figure 22:
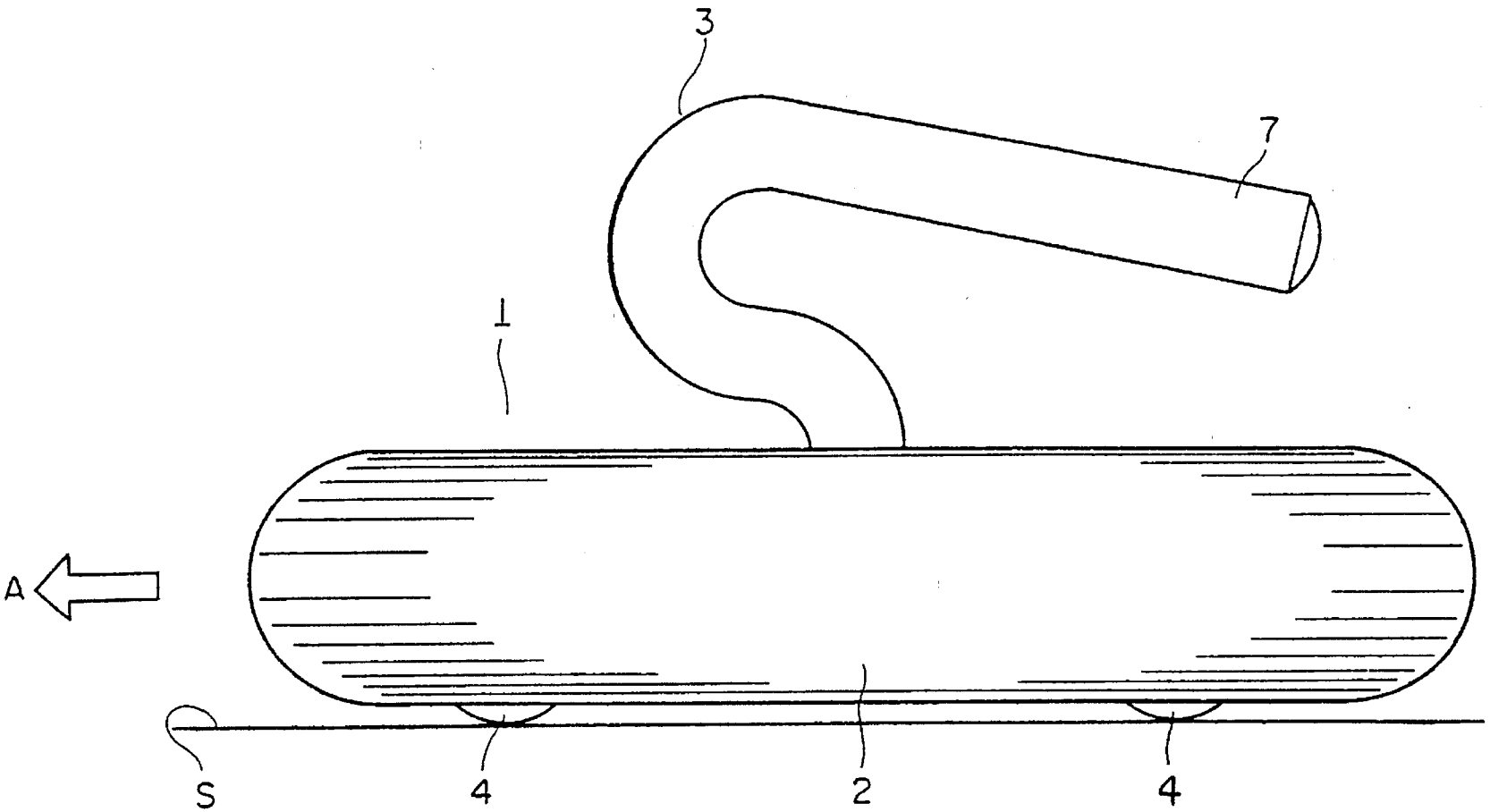
FIG. 22 is a side view of a gliding object for use as recreational sporting goods constructed according to the present invention.

The reference numeral 1 shown in FIG. 1 and FIG. 22 represents a gliding object for use as recreational sporting goods.

The gliding object 1 comprises the discal body 2, the handle 3 which is a part to be pressed with the hand and is fixed at the upper portion of the body 2, and the rolling members 4 which are detachably equipped at the front and rear of the bottom of the body 2 and adapted to rotate in the gliding direction A. The body 2 is made of a suitable material such as hard urethane or plastic (polycarbonate, phenol, cellulosic resin) which is excellent with respect to hardness and is impulse proof.

Figure 2:
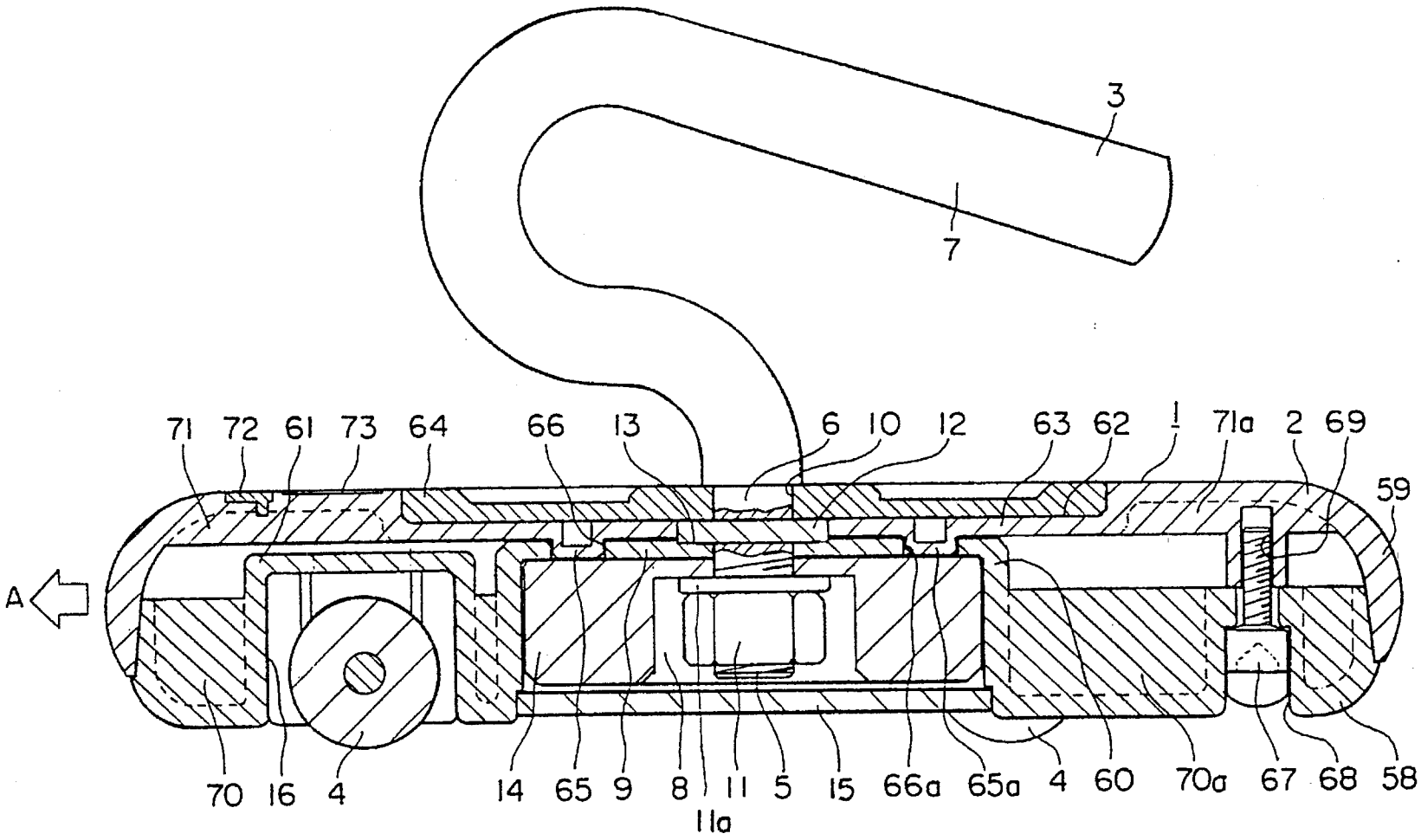
FIG. 2 is a partial cross sectional view of a gliding object shown in FIG. 1.
Figure 23:
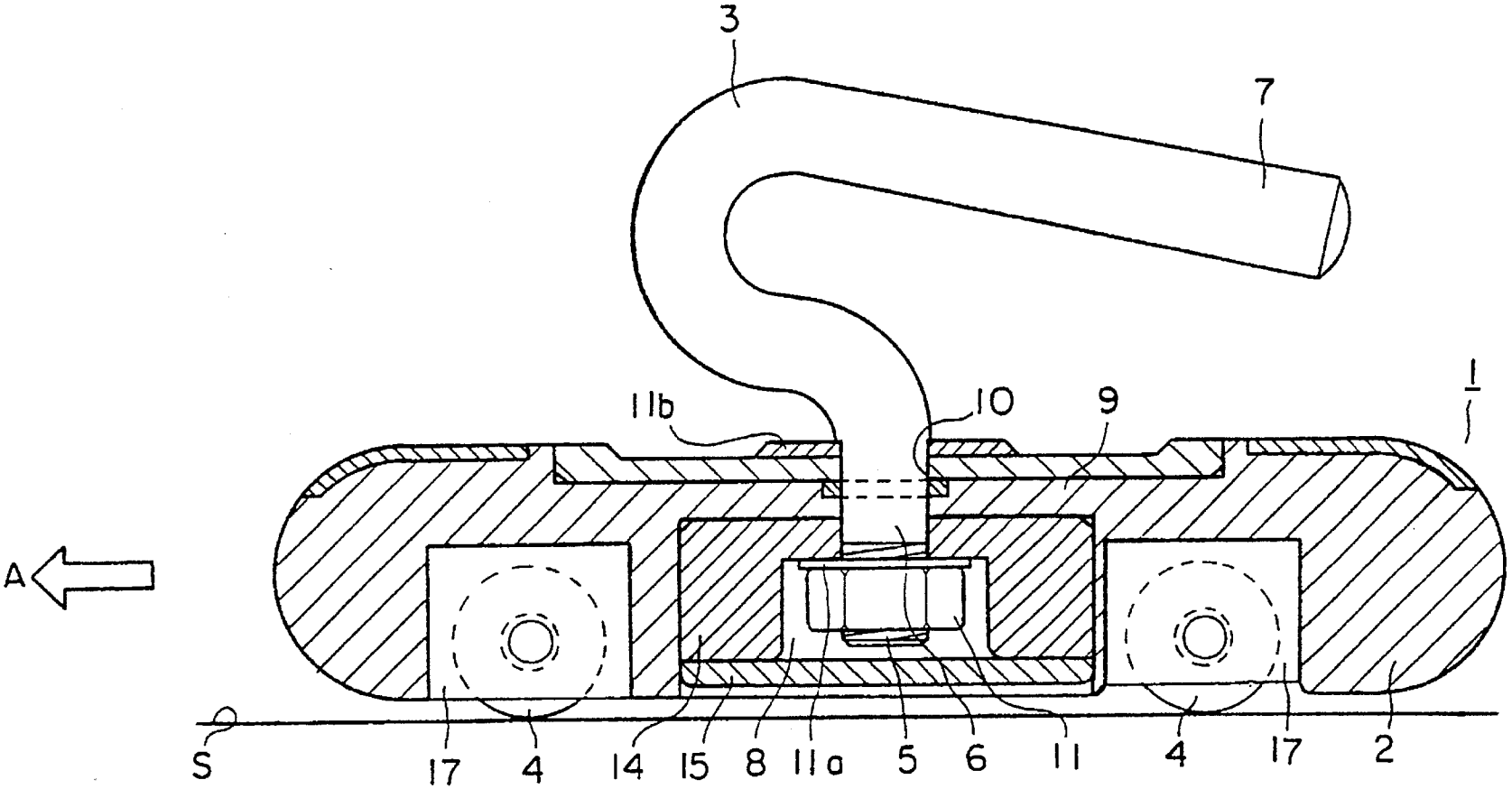
FIG. 23 is a partial cross sectional view of a gliding object shown in FIG. 22.
Figure 24:
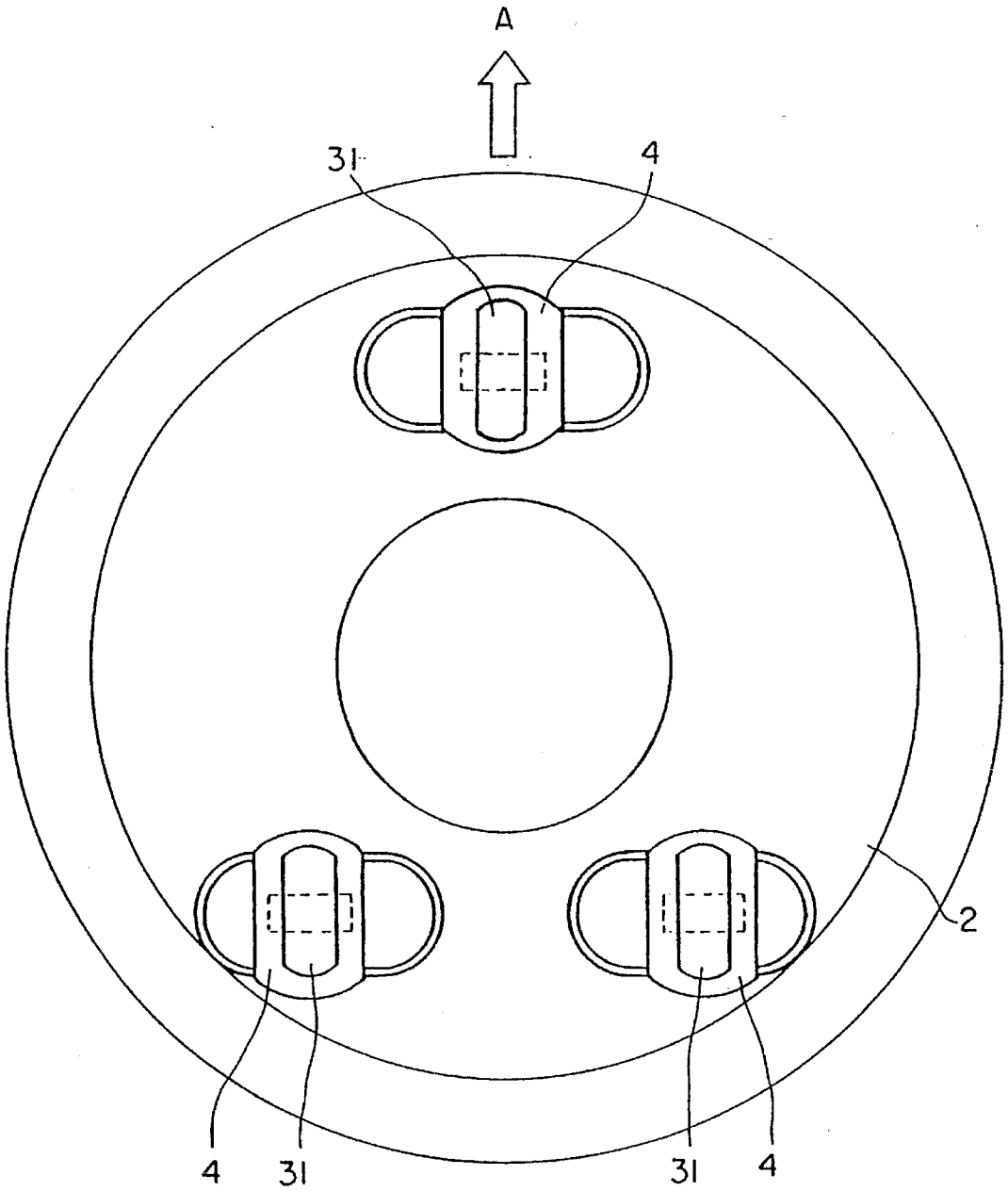
FIG. 24 is a bottom view of a gliding object shown in FIG. 22.
Figure 25:
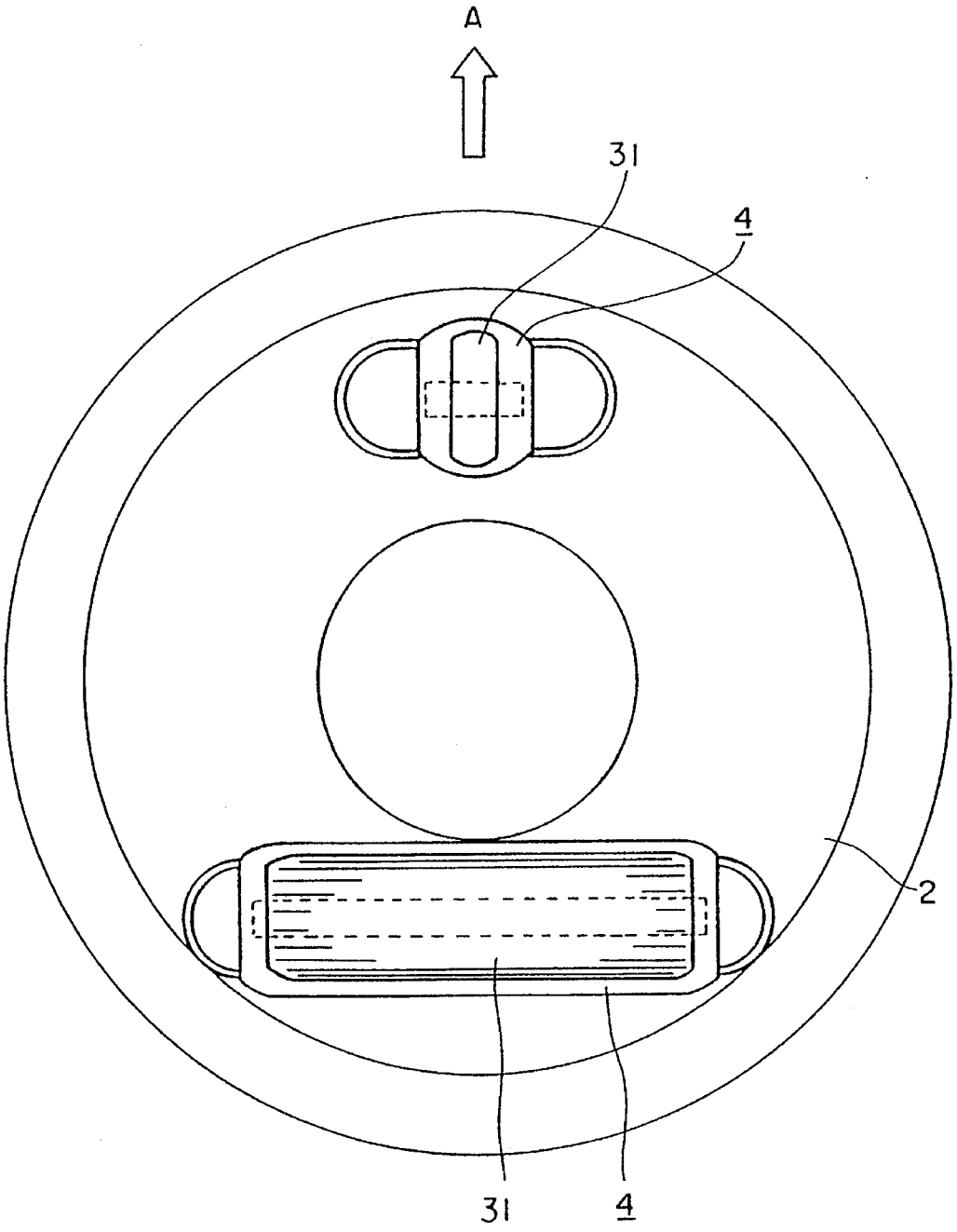
FIG. 25 is a bottom view of another embodiment of a gliding object shown in FIG. 24.

The handle 3 shown in FIG. 2 and FIG. 23 comprises the vertical base 6 on which the threads 5 are formed, an arc part, and the oblique grip 7 whose diameter is longer as lower.

Moreover, a method of fixing the handle 3 to the body 2 is to insert the vertical base 6 of the handle 3 into the aperture 10, which is bored in the upper wall 9 of the cylindrical hole 8, and then to screw the nut 11 on the threads 5 of the vertical base 6. The cylindrical hole 8 is arranged at the center of the bottom of the body 2 and the reference numerals 11*a*, 11*b* represent washers.

Furthermore, although the threads 5, the cylindrical hole 8, and the nut 11 are respectively required at the time of fixing the handle 3 to the body 2, it is also possible to adopt other fixing parts. For example, it is possible to arrange the key 12 or the key way 13 between the aperture 10 and the inserted vertical base 6 lest the handle 3 rotate. It is possible to adjust the weight of the gliding object 1 by equipping the weight 14 in the cylindrical hole 8, and to press and fix the cover 15 on the lower opening face of the cylindrical hole 8.

In the present embodiment, the rolling member 4 projects 3–4 millimeters downward from the bottom of the body 2 to glide on the gliding surface S.

The rolling member 4 is constructed by engaging the wheel members 18, 18*a* . . . in the cassette 17, for example, by resilient detents as described herein. The cassette 17 is fitted in the hollows 16, 16*a* . . . which are formed at the front and rear sides of the bottom of the body 2 to correspond with the gliding direction A. With such a structure, the rolling member 4 can be detachably fixed to the body 2.

The first rolling member 4*a* will be described as follows. The cassette 17 is formed as shown in FIGS. 6 to 9. The upper and lower openings 19, 19*a* are formed by the box 20 which is made of a flexible material such as plastic. The cuts 22, 22*a* are grooved in the opposite side walls 21, 21*a* of the box 20. The engaging strips 23, 23*a*, which are the inside portions of the cuts 22, 22*a*, project upward. The outside faces of the strips 23, 23*a* are level with those of the side walls 21, 21*a*. The thickness of the strips 23, 23*a* is thinner than that of the side walls 21, 21*a*. The fastening pawls 25, 25*a*, which project outward, are formed at the tips of the strips 23, 23*a* and the taper guides 24, 24*a* are formed by the outside faces of the pawls 25, 25*a*. The supporting projections 26, 26*a* are arranged on the lower inside portion of the side walls 21, 21*a* to support the wheel members 18, 18*a*.

The wheel member 18 comprises the portal bearing 27 which is fitted in the cassette 17, the supporting shaft 29 which is built horizontally between the side walls 28, 28*a* of the bearing 27, the wheel 30 which is equipped on the supporting shaft 29, and the circular tire 31 which is attached around the wheel 30. The tire 31 is made of a suitable material such as gum or plastic. As to the wheel member 18*a*, the supporting shaft 29 is built so as to be oblique to a horizontal line extending between the side walls 28, 28*a* of the bearing 27. The wheel member 18*a* is fitted in the cassette 17, and then said cassette 17 is fixed in the hollow 16 which is positioned at the forward center of the bottom of the body 2.

Figure 7:
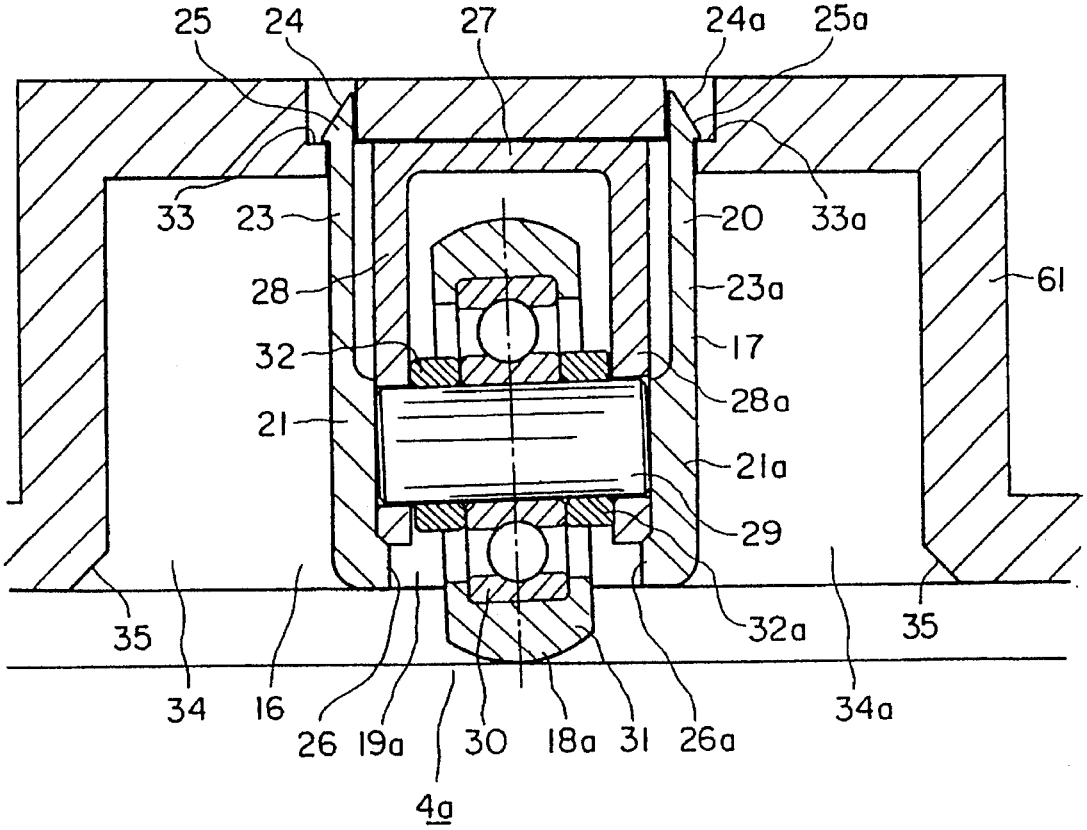
FIG. 7 is a cross sectional view of the first front rolling member shown in FIG. 6.
Figure 8:
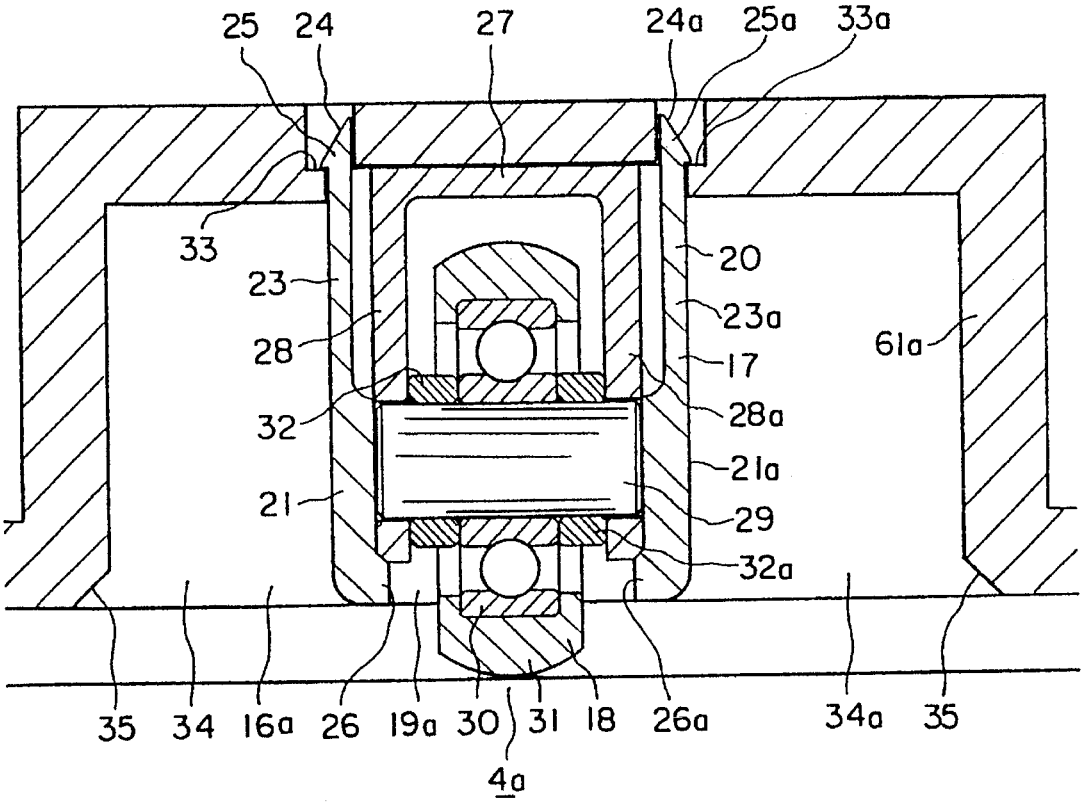
FIG. 8 is a cross sectional view of the first rear rolling member wherein a tire is vertical.
Figure 9:
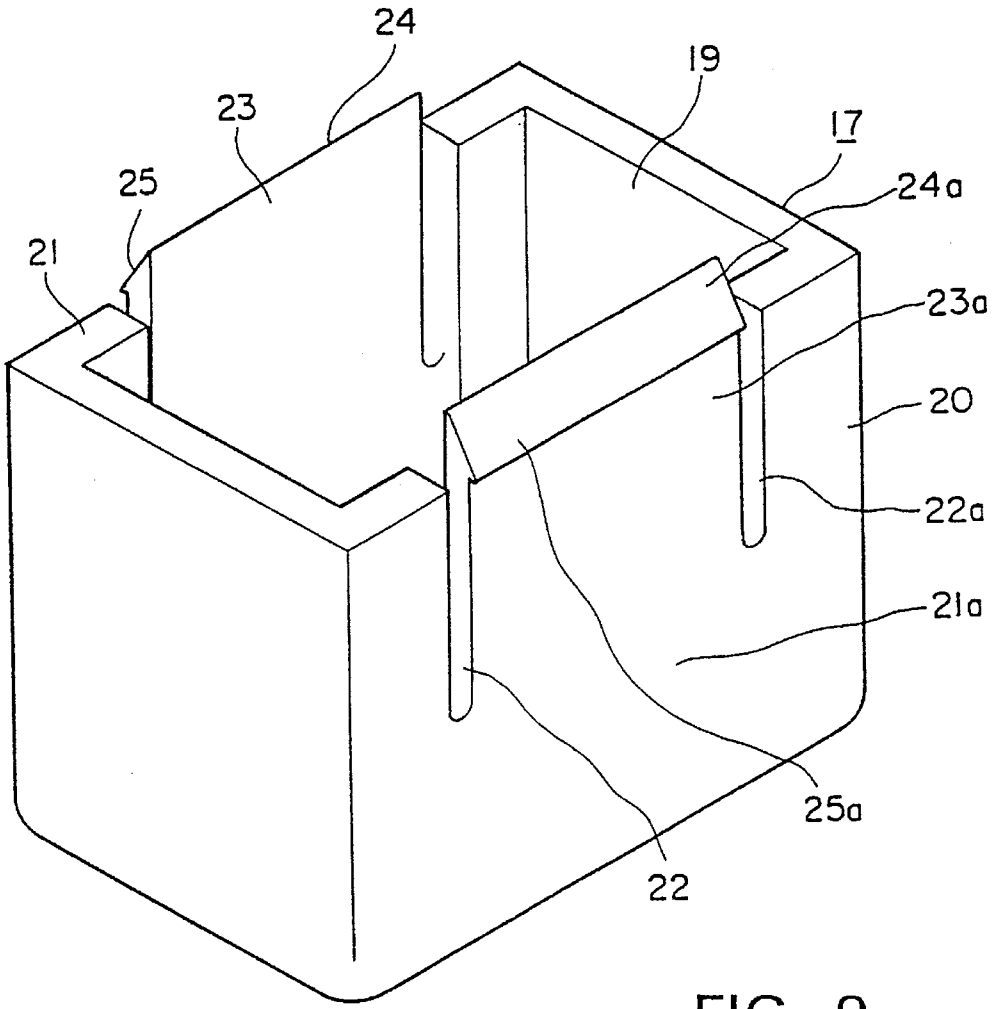
FIG. 9 is an isometric view of a cassette of the first rolling member.

The reference numeral 32, 32*a* shown in FIG. 7 and FIG. 8 represent collars which prevent the wheel 30 from moving along the shaft direction.

Furthermore, the hollows 16, 16*a* . . . in which the first rolling member 4*a* is fitted will be described as follows. The stages 33, 33*a* are engaged with the fastening pawls 25, 25*a* of the engaging strips 23, 23*a* of the cassette 17. The reference numeral 34, 34*a* represent spaces for fingers (not illustrated) to hold the engaging strips 23, 23*a*. The spaces 34, 34*a* are formed at both sides of the hollows 16, 16*a* . . . .

Moreover, it is possible to arrange a buffer (not illustrated) at the portion where the cassette 17 is adjacent to the hollows 16, 16*a* . . . . The buffer has an elastic function to absorb impulse forces at the time the wheel members 18, 18*a* . . . are impulsed and the R-shaped chamfer 35 is formed at the opening edges of the spaces 34, 34*a*.

Figure 3:
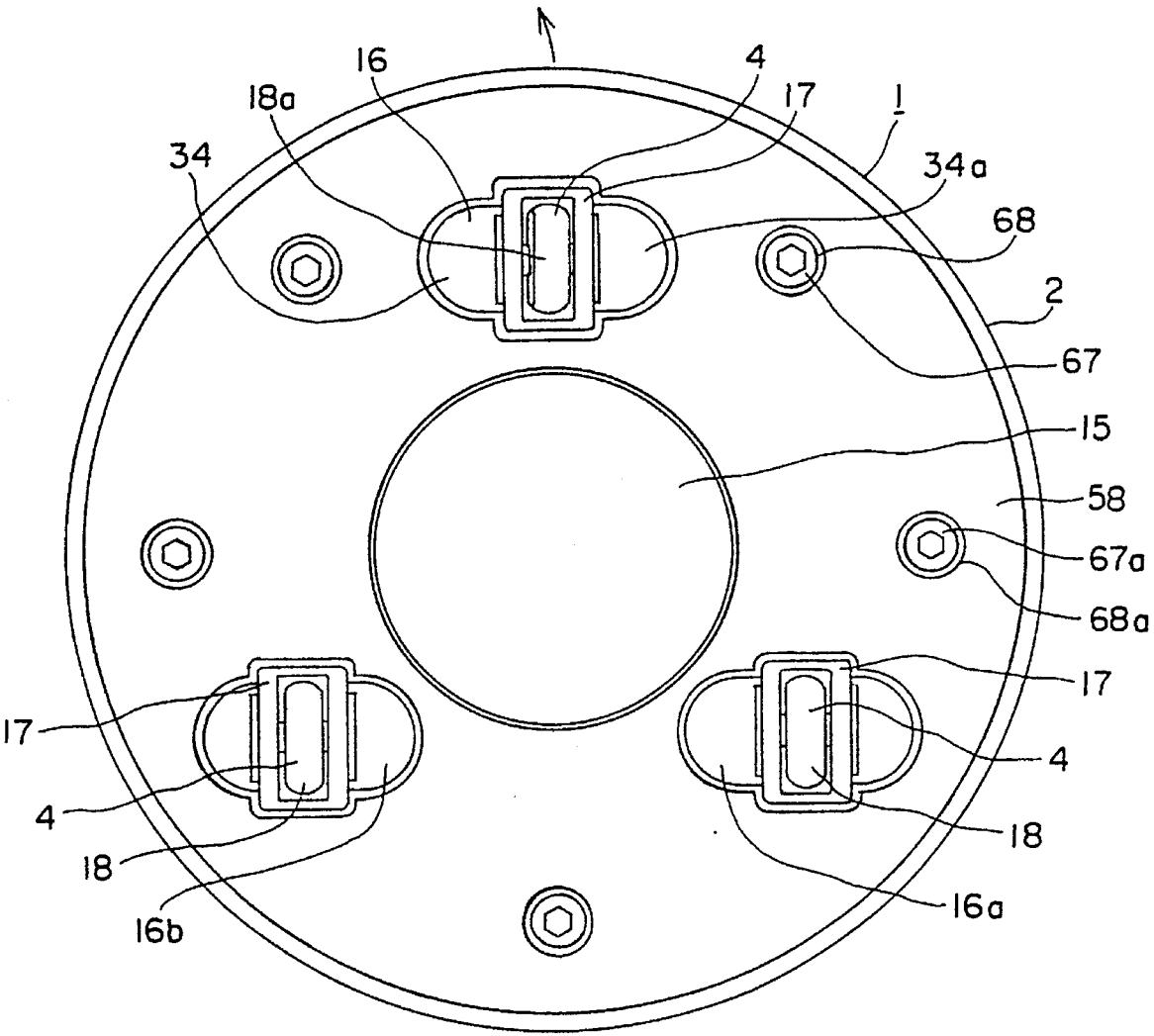
FIG. 3 is a bottom view of a gliding object shown in FIG. 1.
Figure 4:
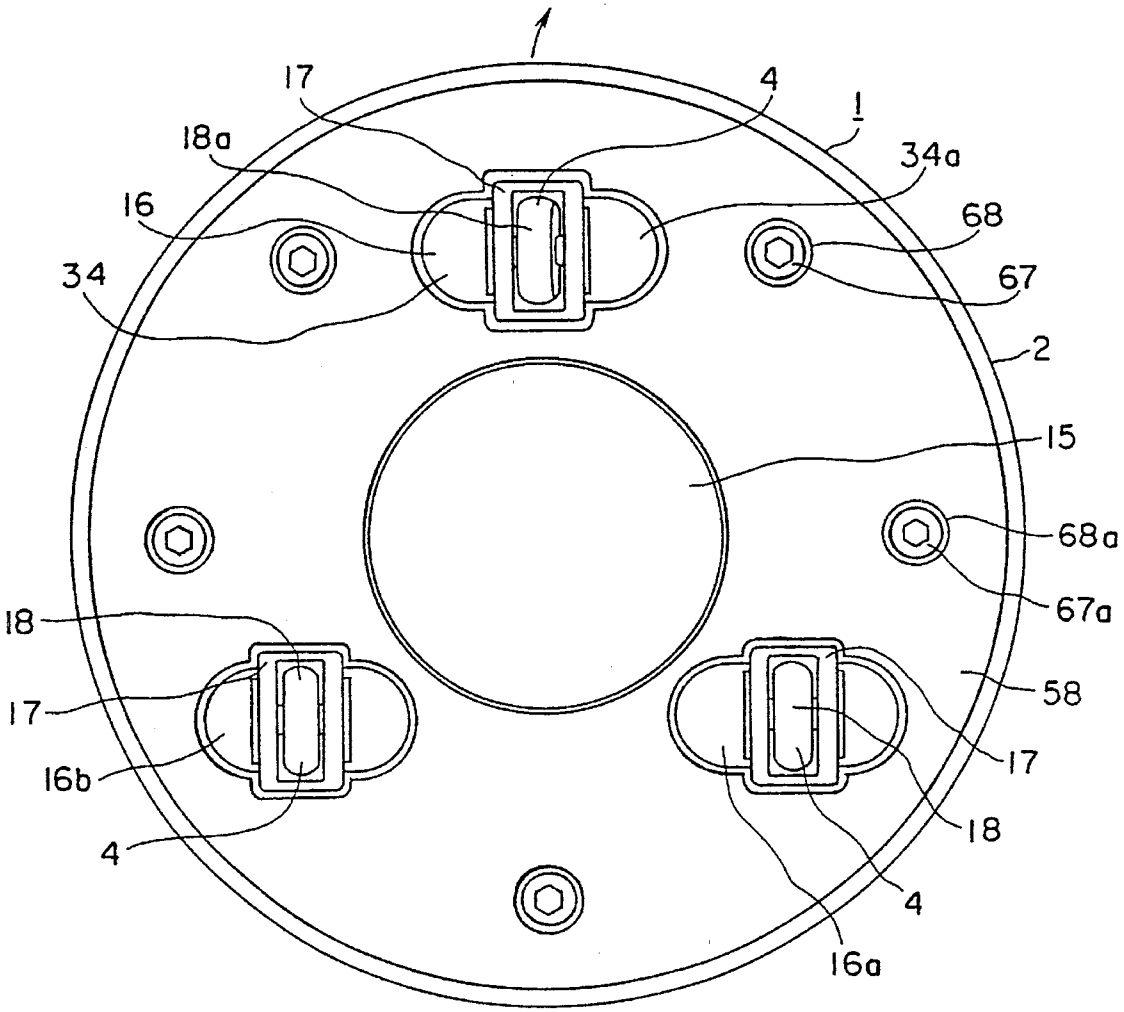
FIG. 4 is a bottom view of another embodiment of a gliding object shown in FIG. 3.
Figure 5:
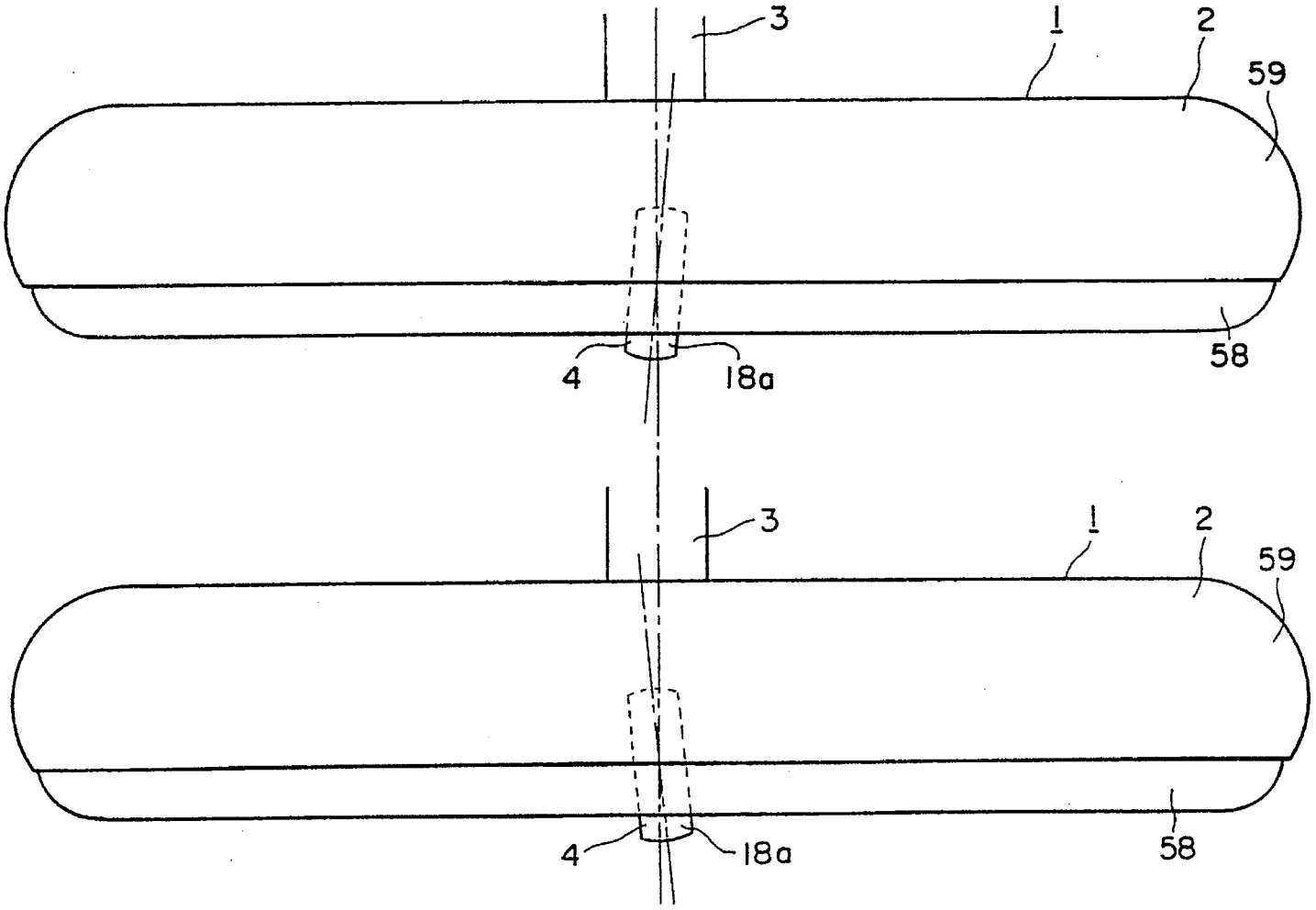
FIG. 5 is a front view of a gliding object wherein tires of front rolling members are alternatively banked to the right or left side.
Figure 6:
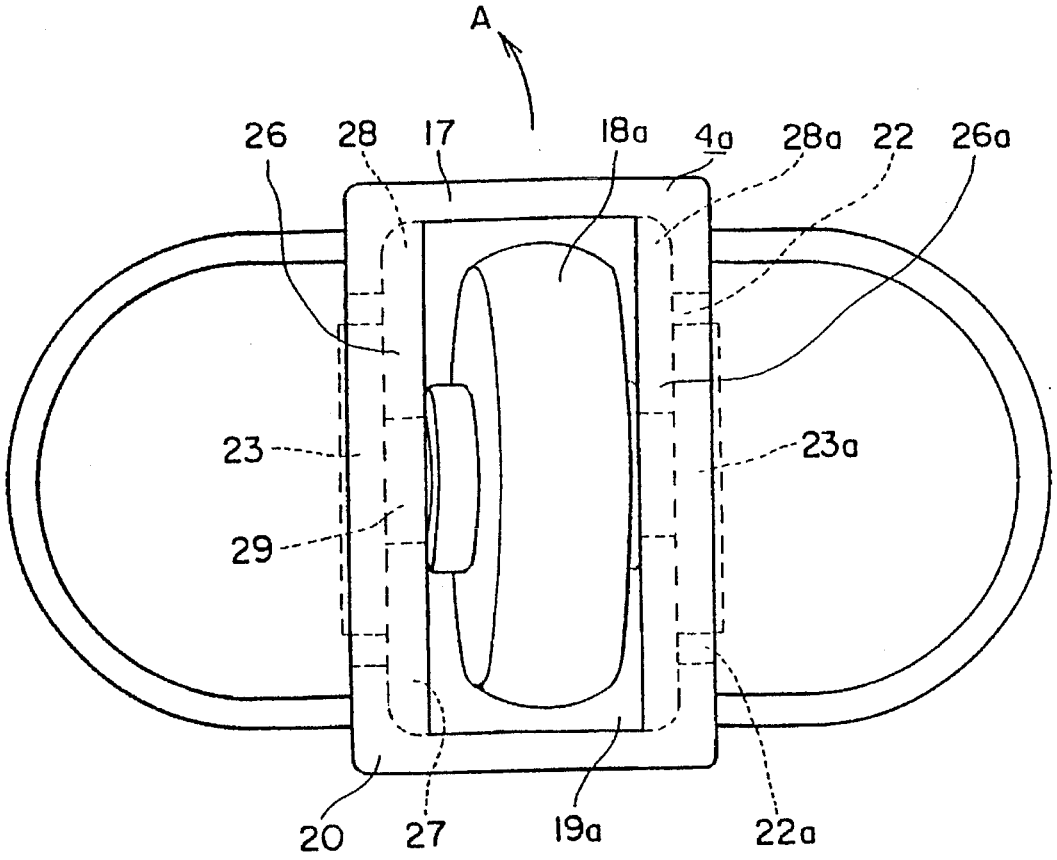
FIG. 6 is a bottom view of the first front rolling member wherein a tire is banked.

In the case that the rolling members 4 are positioned so as to be in the three-wheel form, as shown in FIG. 3, FIG. 4, etc., a front rolling member is fixed at the forward position corresponding with the gliding direction A, and two rear rolling members are fixed at both sides. However, it is possible to exchange a front rolling member with two rear rolling members and, in addition, to widen the width of the tire 31 so as to be a roller. The number of the fixed rolling members 4 is not limited to three pieces.

Figure 10:
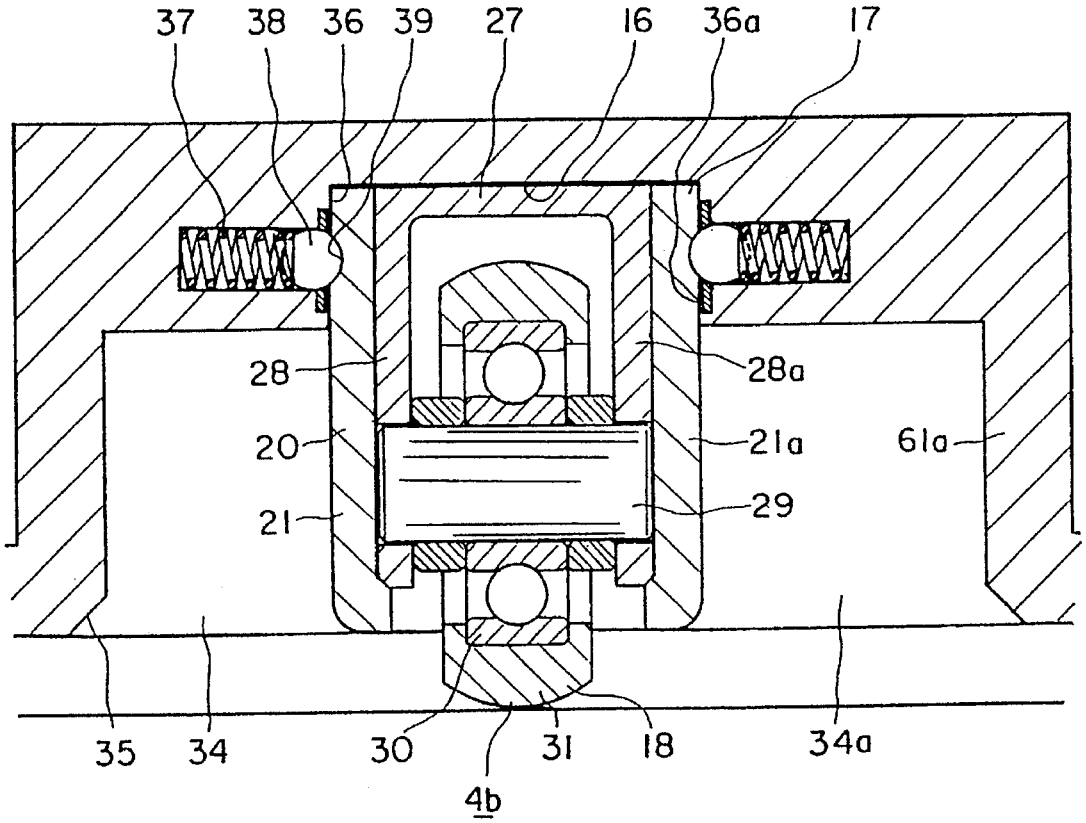
FIG. 10 is a cross sectional view of the second rolling member.

As another embodiment, the second rolling member 4*b* will be described as follows. As shown in FIG. 10, the upper portion of the cassette 17 is fitted between the opposed side faces 36, 36*a* of the hollows 16, 16*a* . . . . The balls 38 are positioned at the opening in the side faces 36, 36*a*. The springs 37 push the balls 38 inward. A part of each ball 38 is fitted in the fitting dent 39 which is formed in the upper outside of the side walls 21, 21*a* of the cassette 17.

Figure 11:
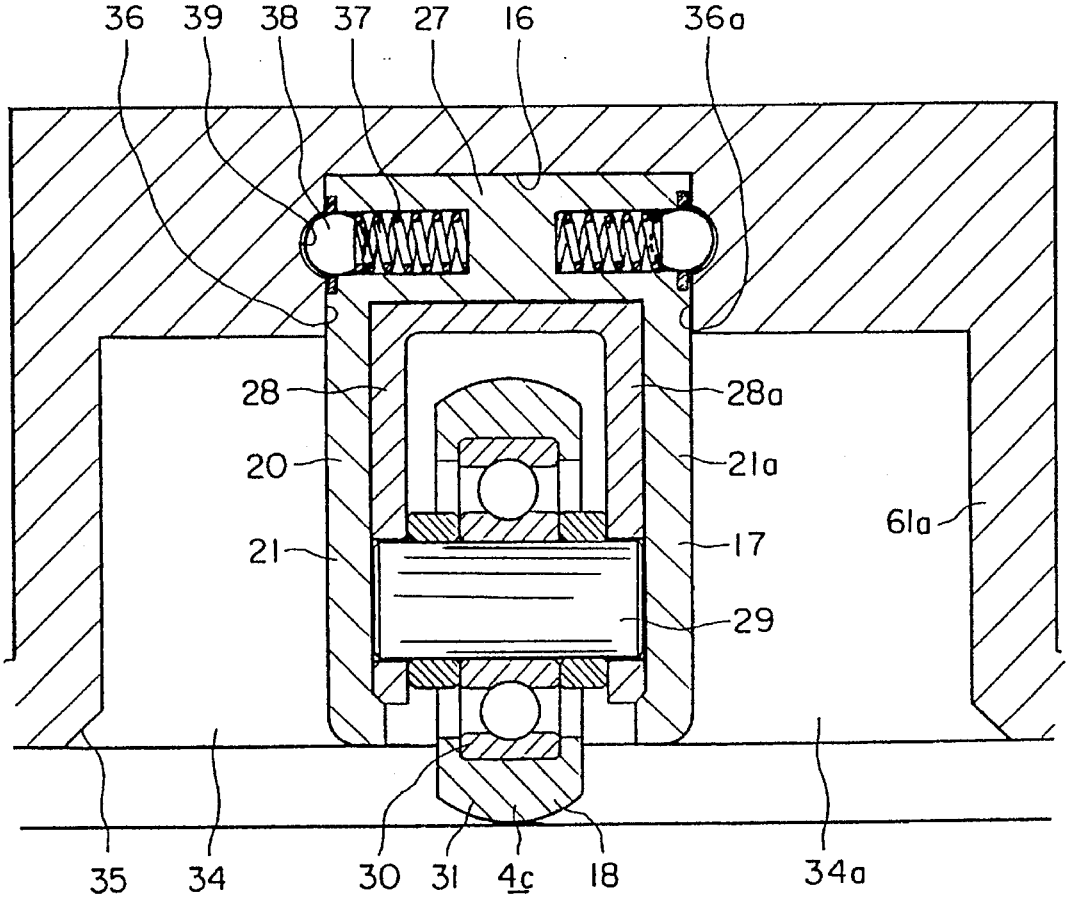
FIG. 11 is a cross sectional view of the third rolling member.

As shown in FIG. 11, the cassette 17 of the third rolling member 4*c* is fitted between the opposed side faces 36, 36*a* of the hollows 16, 16*a* . . . . Inside of the cassette 17, there are the balls 38 which are pushed by the springs 37. The fittings dents 39, which each engage with the balls 38, are formed in each of the side faces 36, 36*a*.

Figure 12:
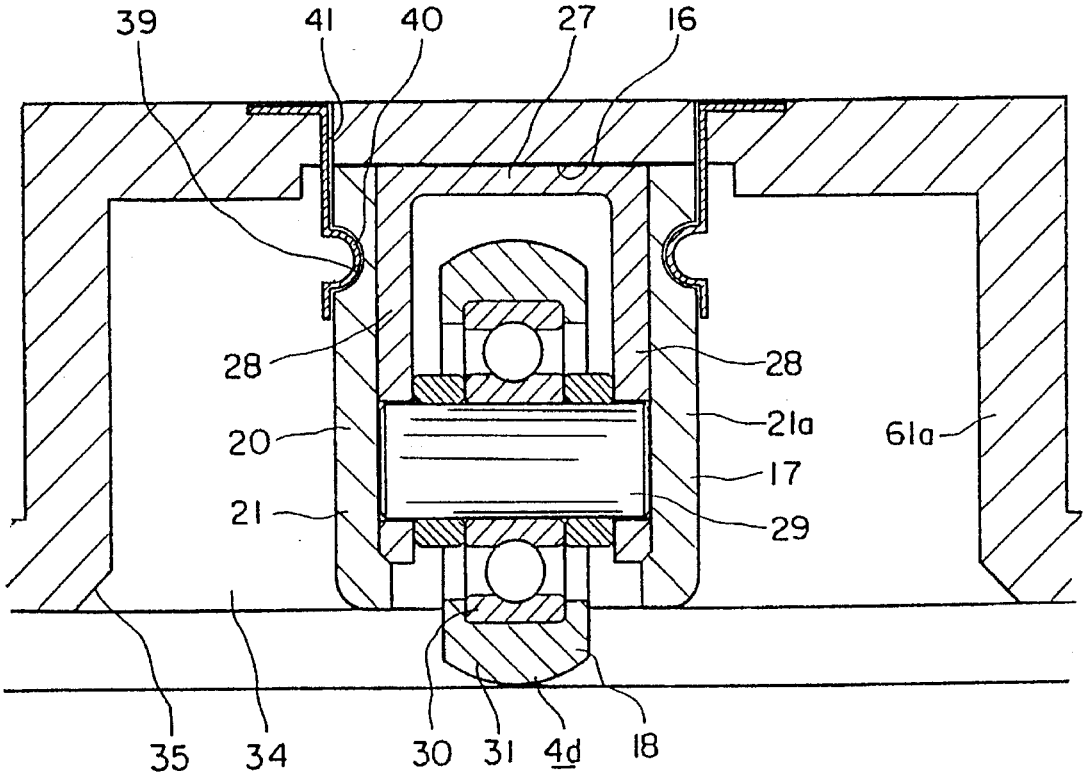
FIG. 12 is a cross sectional view of the fourth rolling member.

As another embodiment, the fourth rolling member 4*d* will be described as follows. As shown in FIG. 12, the hemispheric engaging projection 40 is formed at the lower portion of the engaging plate spring 41. The plate spring 41 is arranged at the opposed side faces 36, 36*a* of the hollows 16, 16*a* . . . in which the upper portion of the cassette 17 is fitted. A part of the engaging projection 40 of the plate spring 41 is fitted in the fitting dent 39 which is formed in the upper outside of the side walls 21, 21*a* of the cassette 17.

In the case of the aforementioned embodiments, it is possible to construct the gliding object 1 according to the present invention easily by unifying upper and lower sections to form the body 2.

Figure 13:
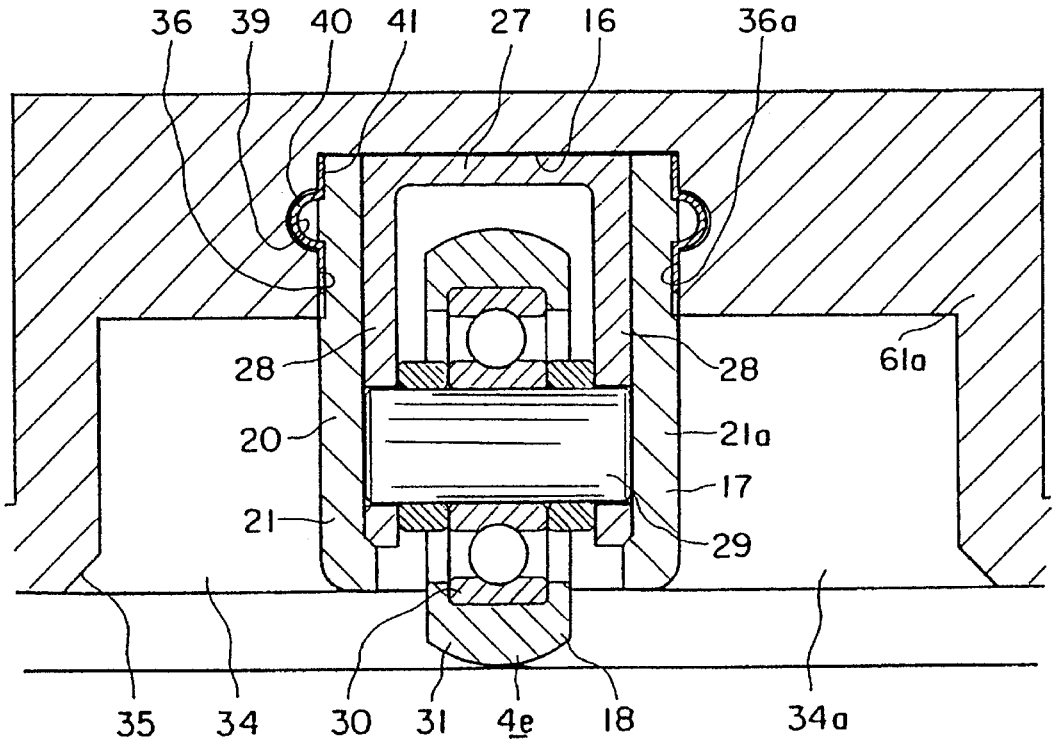
FIG. 13 is a cross sectional view of the fifth rolling member.

As to the fifth rolling member 4*e* shown in FIG. 13, the engaging plate spring 41 is equipped on the cassette 17. The hemispheric engaging projection 40 of the plate spring 41 is fitted in the fitting dent 39 which is formed in the opposed side faces 36, 36*a* of the hollows 16, 16*a* . . . .

Figure 14:
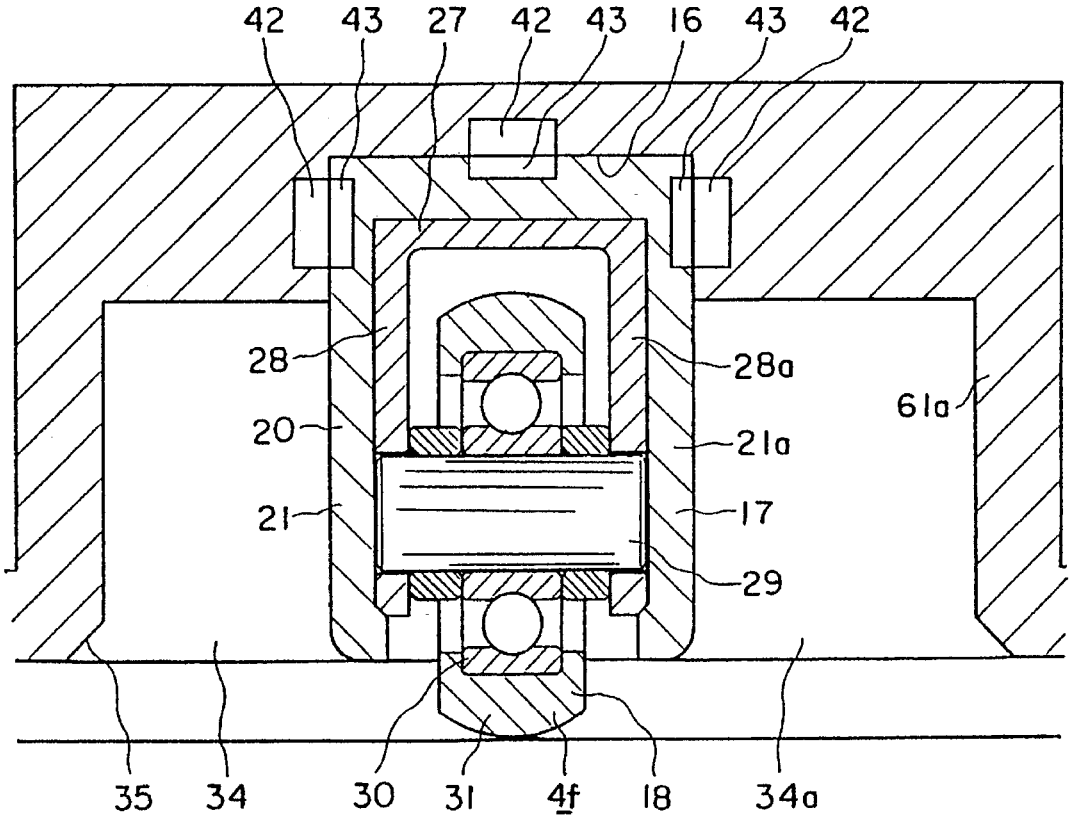
FIG. 14 is a cross sectional view of the sixth rolling member.

Moreover, as another embodiment, the sixth rolling member 4*f* will be described as follows. As shown in FIG. 14, the permanent magnet 42 is attached to the opposed side faces 36, 36*a* of the hollows 16, 16*a* . . . in which the upper portion of the cassette 17 is fitted. The magnetic member 43 is attached to the upper outside of the side walls 21, 21*a* of the cassette 17. The cassette 17 is firmly held by the magnetic attraction of the permanent magnet 42.

With such a magnetic structure, it is difficult for the cassette 17 to fall out. Furthermore, it is possible to exchange the permanent magnet 42 with the magnetic member 43 and, in addition, to attach the permanent magnet 42 to the hollows 16, 16*a* . . . and the cassette 17.

Figure 15:
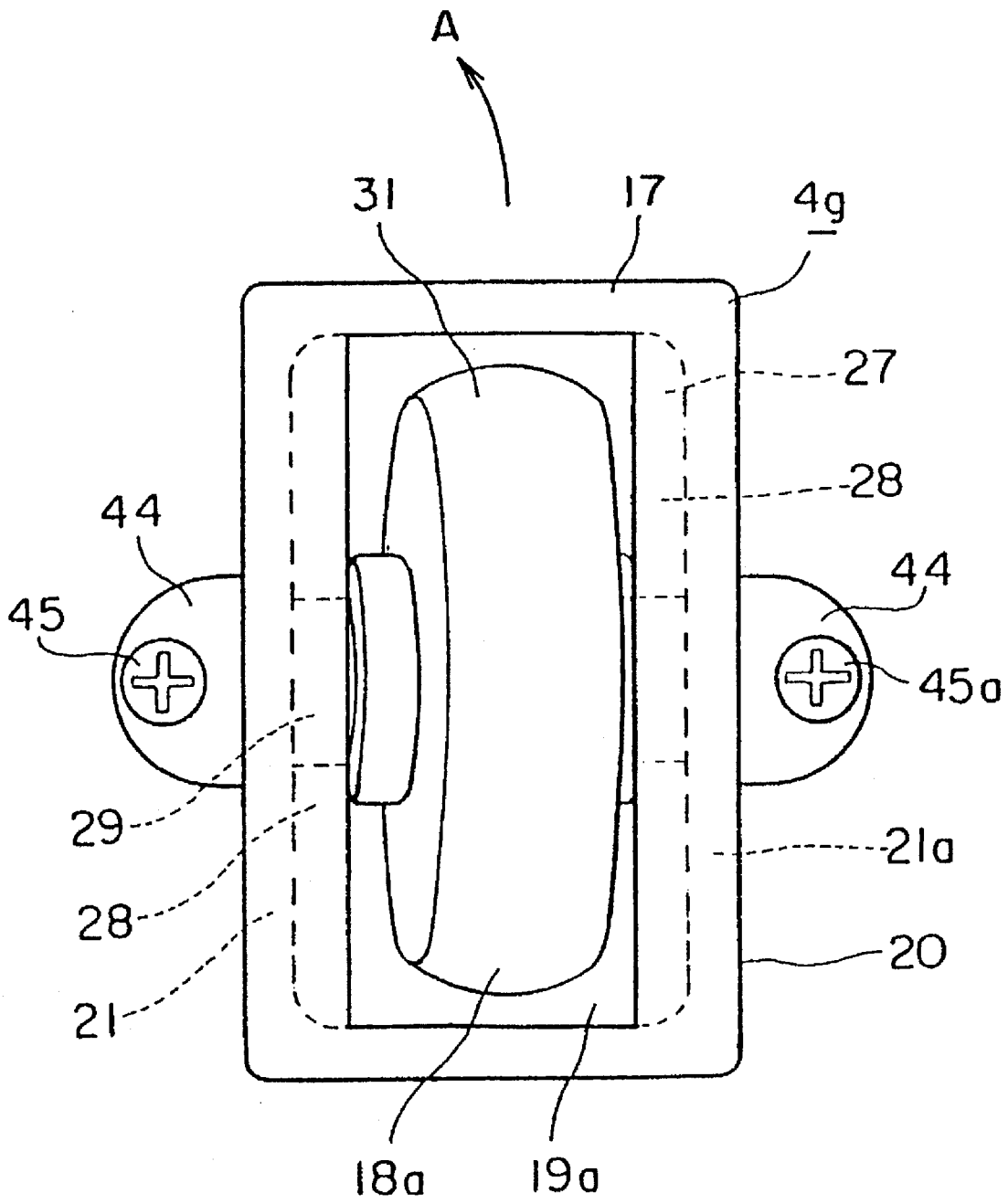
FIG. 15 is a bottom view of the seventh rolling member wherein a tire is banked.

As to the seventh rolling member 4*g* shown in FIG. 15, the projection 44 projects outwardly from the side walls 21, 21*a* of the cassette 17. The female bore (not illustrated), which corresponds to the projection 44, is formed in the bottom of the body 2. The rolling member 4*g* is fixed to the body 2 with the fixing screw 45, 45*a*.

As mentioned above, the gliding object 1 glides through various courses such as straight, slice and hook lines corresponding to the gliding direction A. However, in the case of the three-wheel form shown in FIG. 3 etc. wherein a front rolling member and two side rear rolling members are respectively arranged, there are other embodiments apart from the one shown in FIG. 7 etc. wherein the tire 31 of the front rolling member 4 is banked by fixing the supporting shaft 29 so as to be oblique to a horizontal line.

Figure 16:
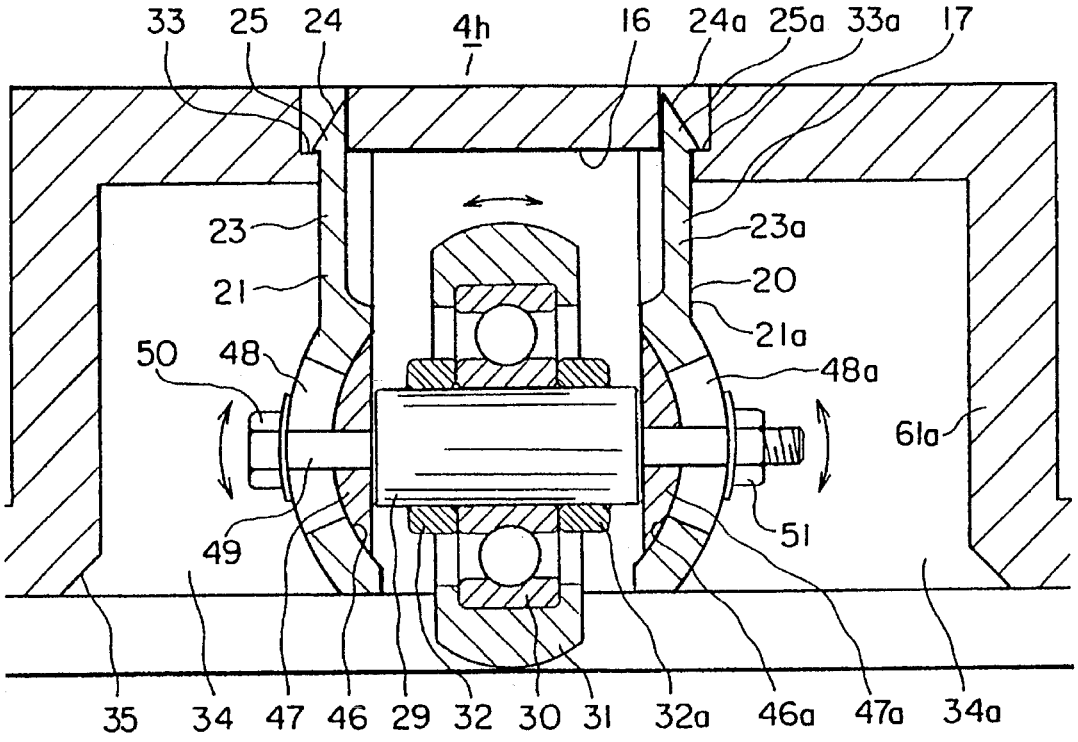
FIG. 16 is a cross sectional view of a rolling member wherein the banked degree of a tire is freely regulated.

As another embodiment, the eight rolling member 4*h* shown in FIG. 16 will be described as follows. The side walls 21, 21*a* of the cassette 17 are outwardly expanded so that the arc concaves 46, 46*a* are formed on the inside of the cassette 17. The arc sliders 47, 47*a* in the arc concaves 46, 46*a* are fixed at both edges of the supporting shaft 29.

The slots 48, 48*a* are engraved in the arc concaves 46, 46*a* of the side walls 21, 21*a*. Both edges of the long bolt 49 which is passed through the supporting shaft 29 are inserted in the arc concaves 46, 46*a*. The bolt head 50, which form an end of the long bolt 49, is adjacent to the outface of the side wall 21 while the nut 51, which is screwed at the other end of the long bolt 49, is adjacent to the outface of the side wall 21*a*.

Figure 17:
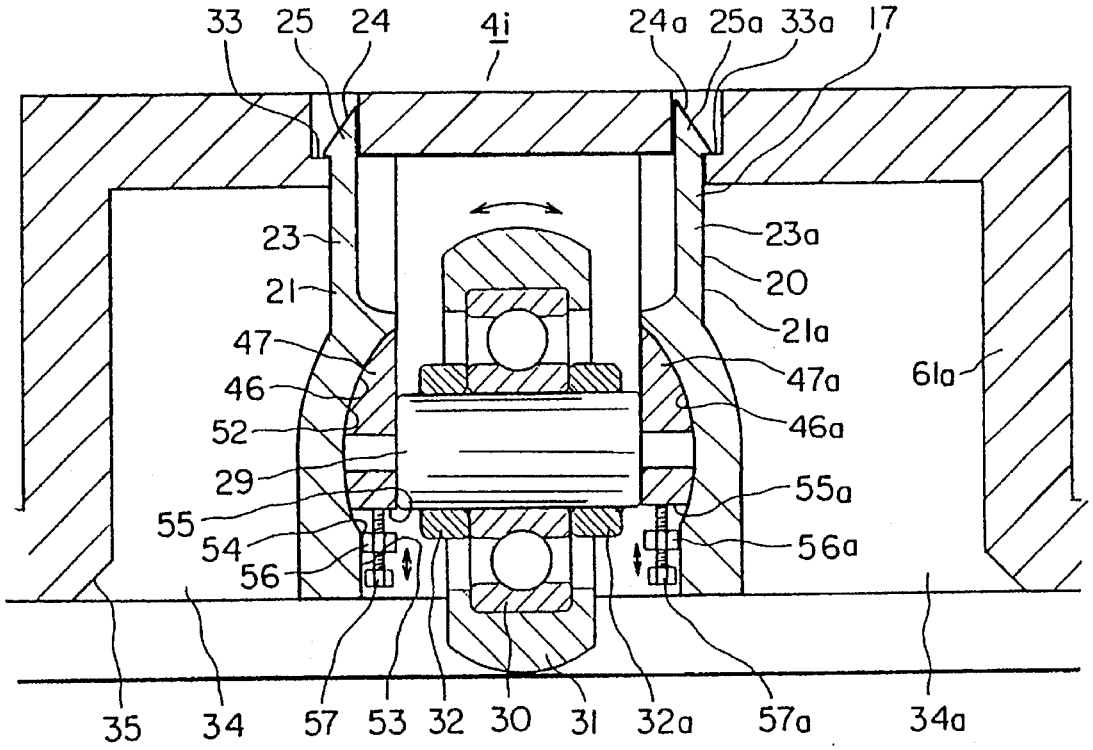
FIG. 17 is a cross sectional view of another embodiment of a rolling member shown in FIG. 16.
Figure 18:
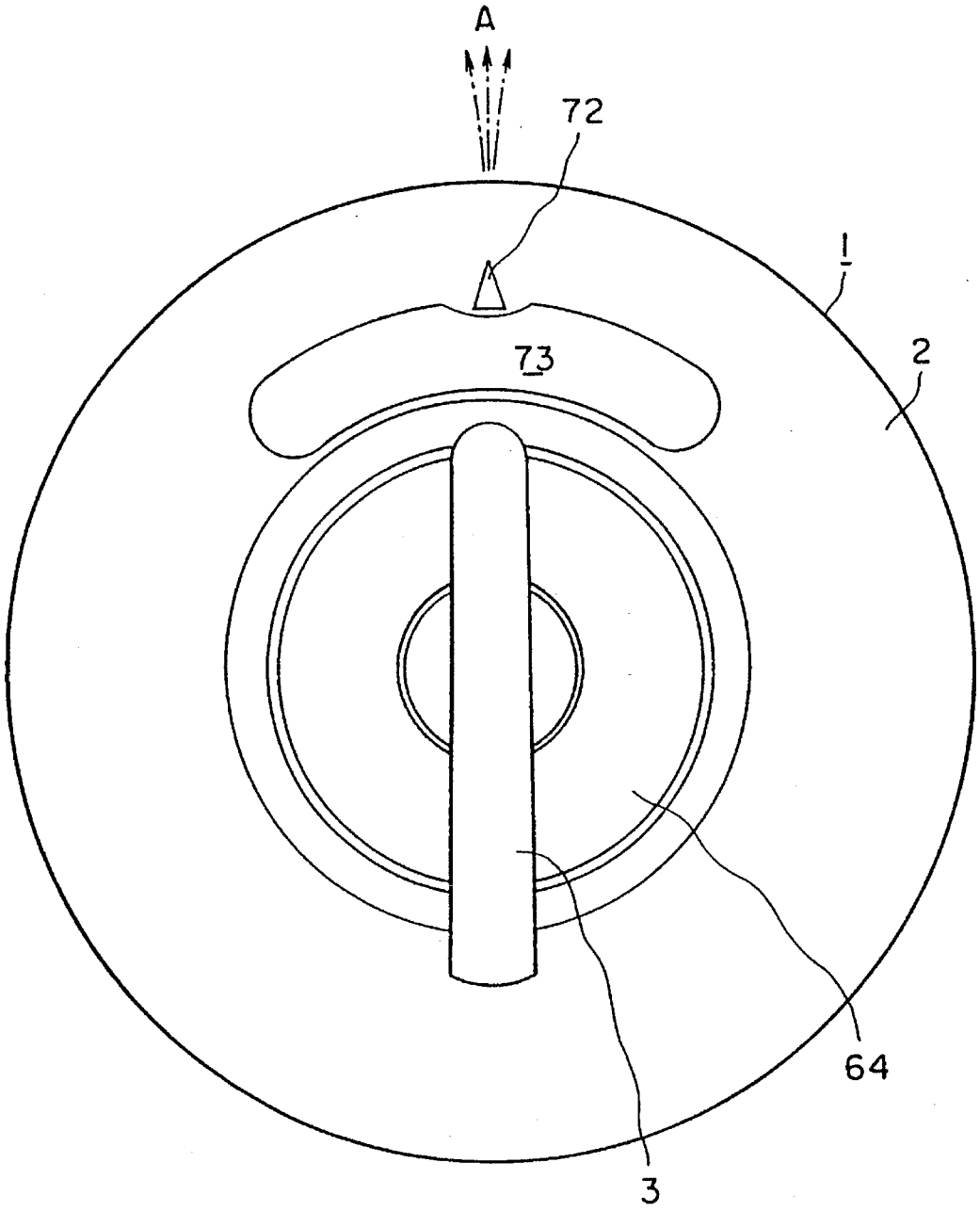
FIG. 18 is a top view of a gliding object which is constructed by unifying upper and lower sections.
Figure 19:
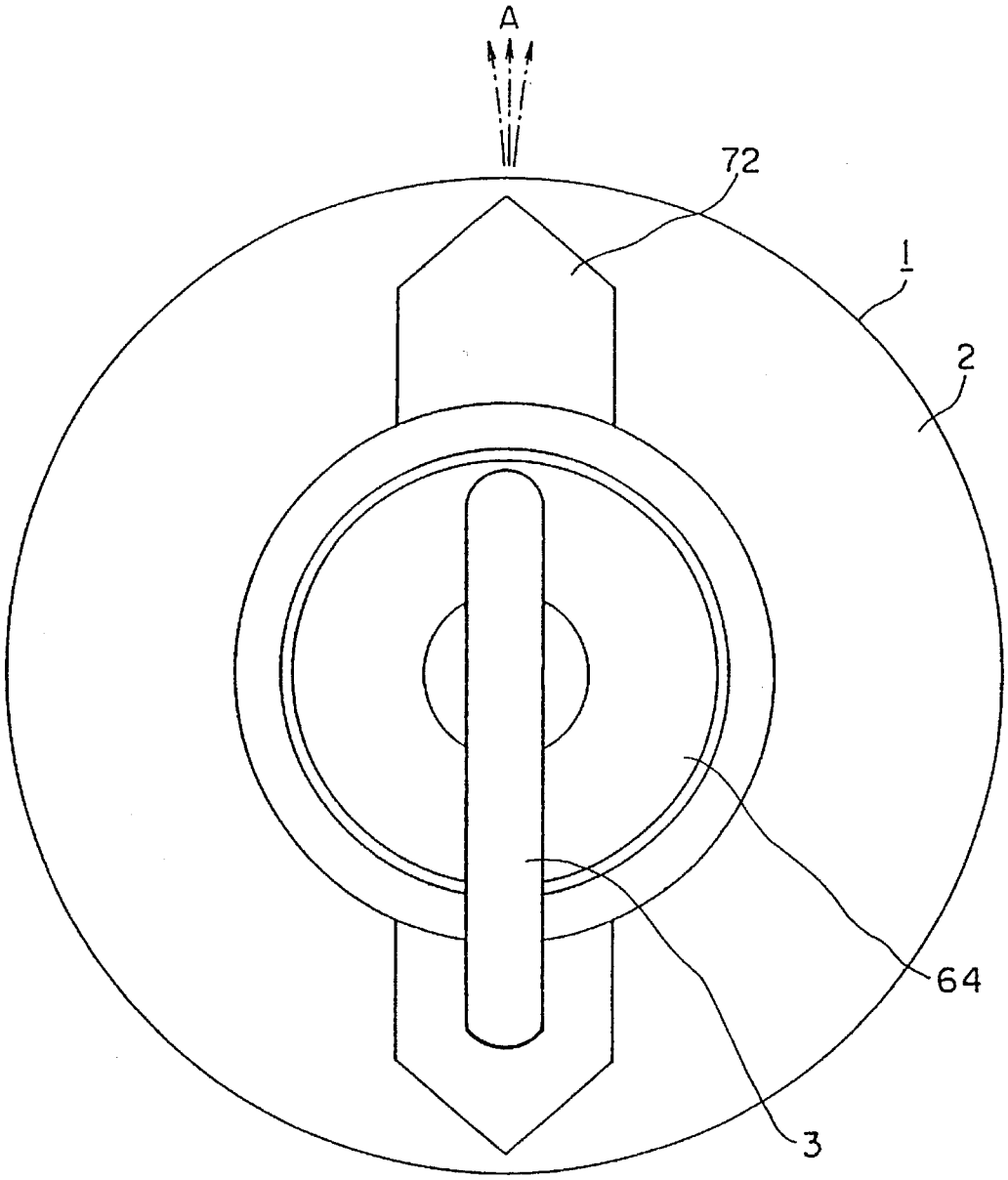
FIG. 19 is a top view of another embodiment of a gliding object shown in FIG. 18.
Figure 20:
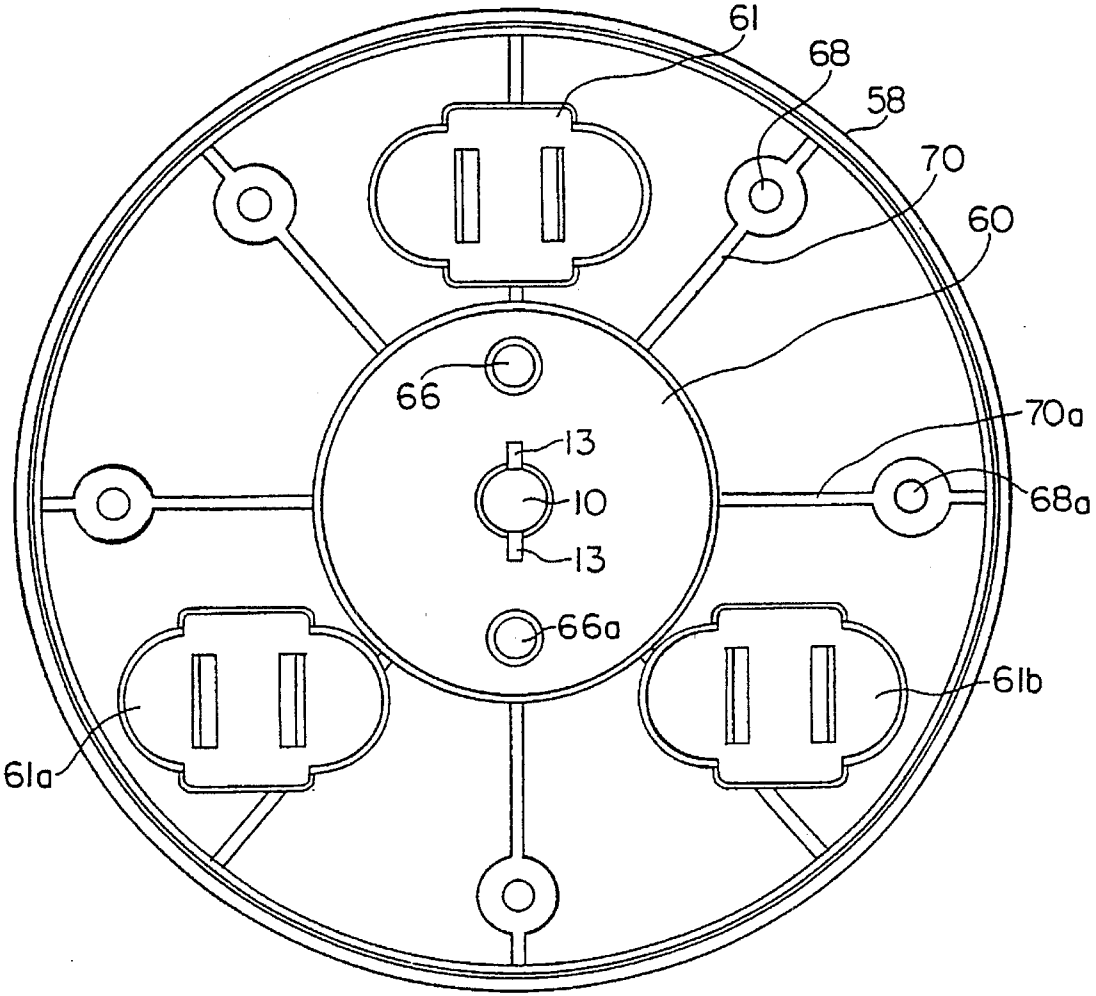
FIG. 20 is an inside view of a lower section of a body.
Figure 21:
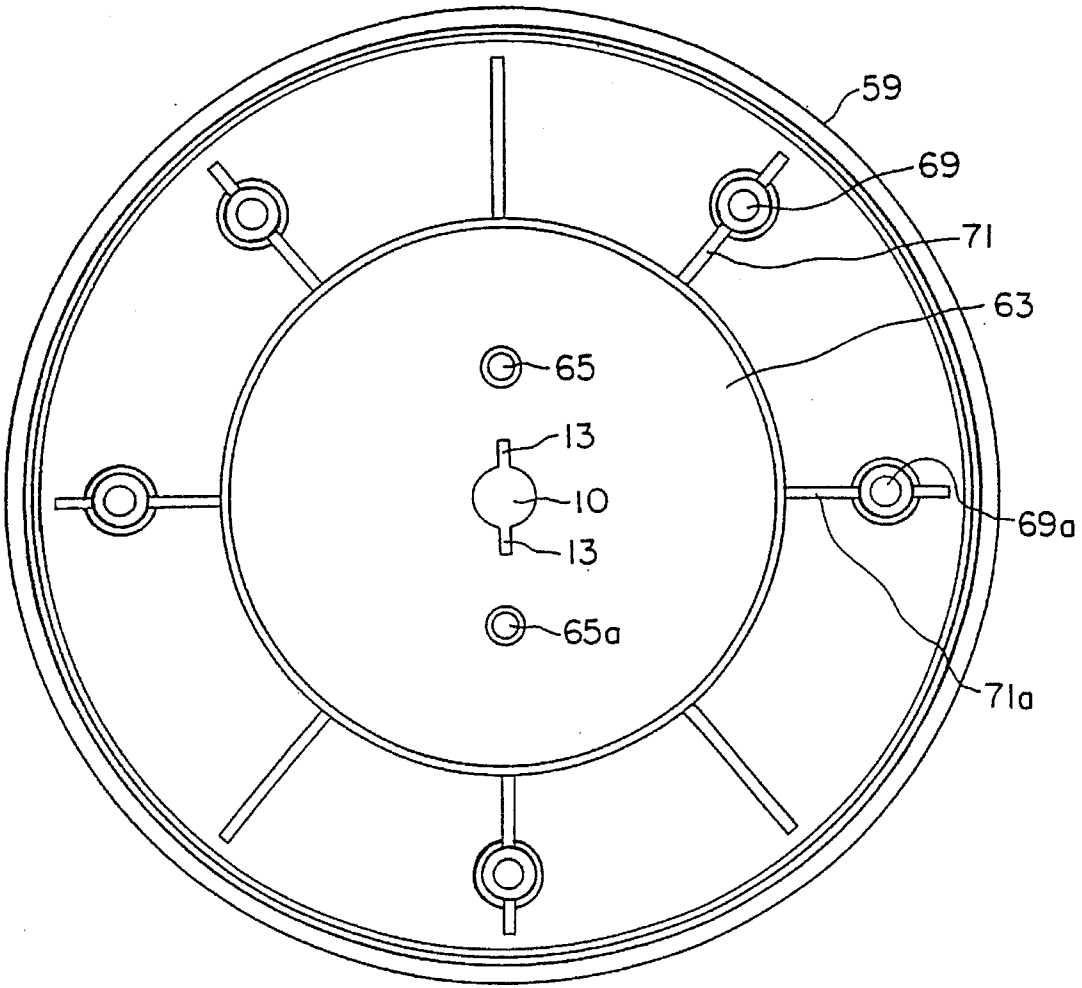
FIG. 21 is an inside view of an upper section of a body.

As another embodiment, the ninth rolling member 4i shown in FIG. 17 will be described as follows. The side walls 21, 21*a* of the cassette 17 are outwardly expanded so that the arc part 52 and the vertical part 53 are integrally formed at the inside face of the arc concaves 46, 46*a*. The position of the boundary 54 between the arc part 52 and the vertical part 53 is farther inwards than the farthest outward extension of the outline of the arc part 52. The flat faces 55, 55*a* are formed below the bottom of the sliders 47, 47*a* which are fixed with both edges of the supporting shaft 29 in the arc concaves 46, 46*a*. The nut members 56, 56*a* are fixed to the vertical part 53 of the arc concaves 46, 46*a*. Tips of the adjusting screws 57, 57*a*, which are screwed in the nut members 56, 56*a*, are adjacent to the flat faces 55, 55*a* of the sliders 47, 47*a*.

Moreover, it is possible to construct the body 2 by connecting the lower section 58 and the upper section 59, as shown in FIG. 1 to FIG. 4. The lower section 58 comprises the connecting part 60, the holding cases 61, 61*a* . . . in which the rolling member 4 is fitted, and the bottom wall which are united together. The cylindrical deep hole 8, which opens downward, is positioned at the center of the connecting part 60 and the holding cases 61, 61*a* . . . open downward so that the hollows 16, 16*a* . . . are formed. The connecting part 63, which projects downward, is arranged at the center of the upper face of the upper section 59. The shallow circular concave 62 is formed in the upper face of the connecting part 63. The metallic plate 64, whose diameter corresponds with that of the circular concave 62, is fitted into the concave 62. To unify the lower section 58 and the upper section 59, the fitting projections 65, 65*a* and the fitted holes 66, 66*a* are respectively arranged at the connecting parts 60, 63.

The reference numeral 67, 67*a* . . . represents screws to unify the lower section 58 and the upper section 59. The tapped holes 68, 68*a* . . . , 69, 69*a* . . . , which have stages, are respectively bored at suitable positions in the inside of the lower section 58 and the upper section 59. The screws 67, 67*a* . . . are inserted and screwed through the tapped holes 68, 68*a* . . . of the lower section 58 and into the tapped holes 69, 69*a* . . . of the upper section 59.

The reference numerals 70, 70*a* . . . , 71, 71*a* . . . represent reinforcement ribs which are radially arranged in the inside of the lower section 58 and the upper section 59.

The mark 72 such as an arrow, triangle or dot, which is attached to the upper face of the body 2, shows the gliding direction A of the gliding object 1. An attachment method may include printing, pasting a seal or fitting a laminate. It is possible to form a mount for a nameplate at the upper face of the body 2, and to paint the body 2 itself. In the present embodiment, the shallow dent 73, which is shaped like a kidney, is formed at the front of the upper face of the body 2 and corresponds with the gliding direction A.

And moreover, as other embodiments of the above-mentioned rolling member 4, parts which are formed different from the aforesaid ones will be described as follows.

Figure 26:
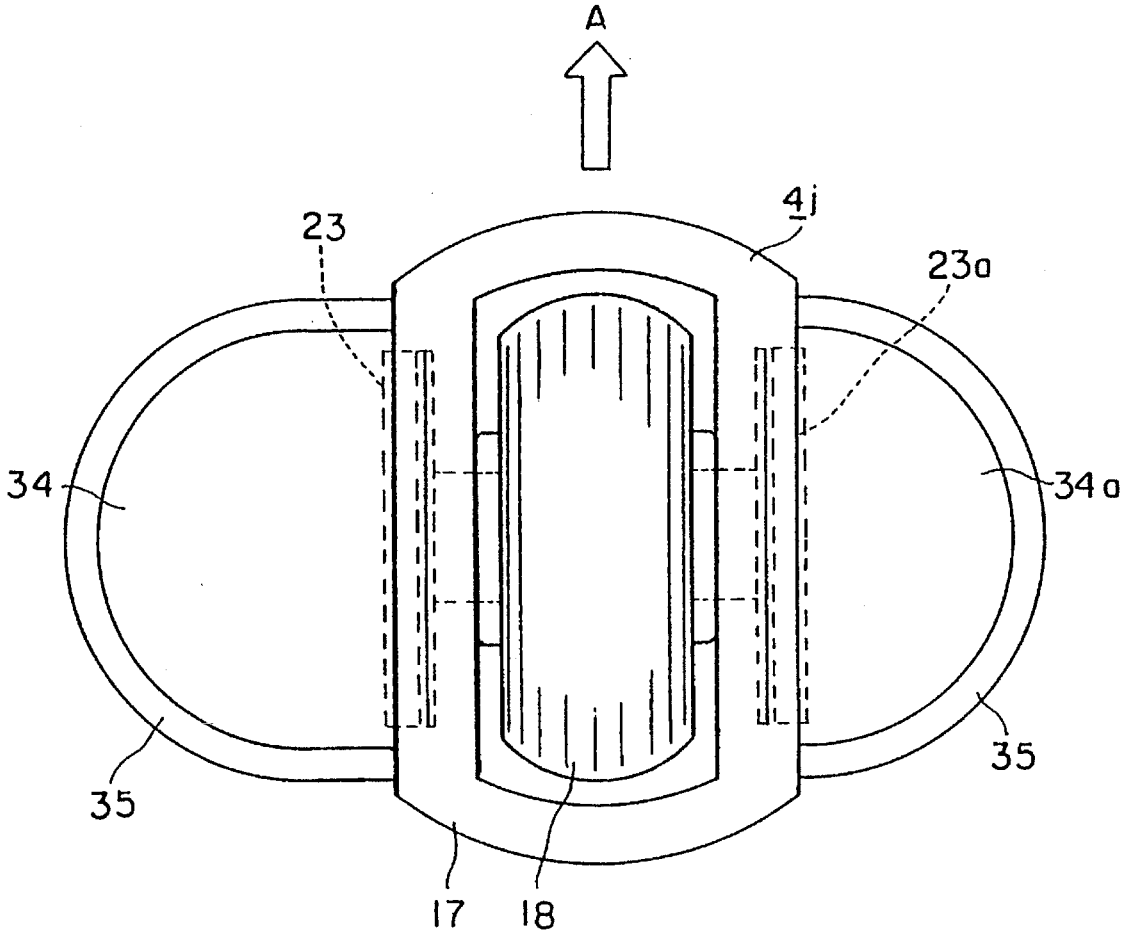
FIG. 26 is a bottom view of a detachable rolling member which resembles the first rolling member.
Figure 27:
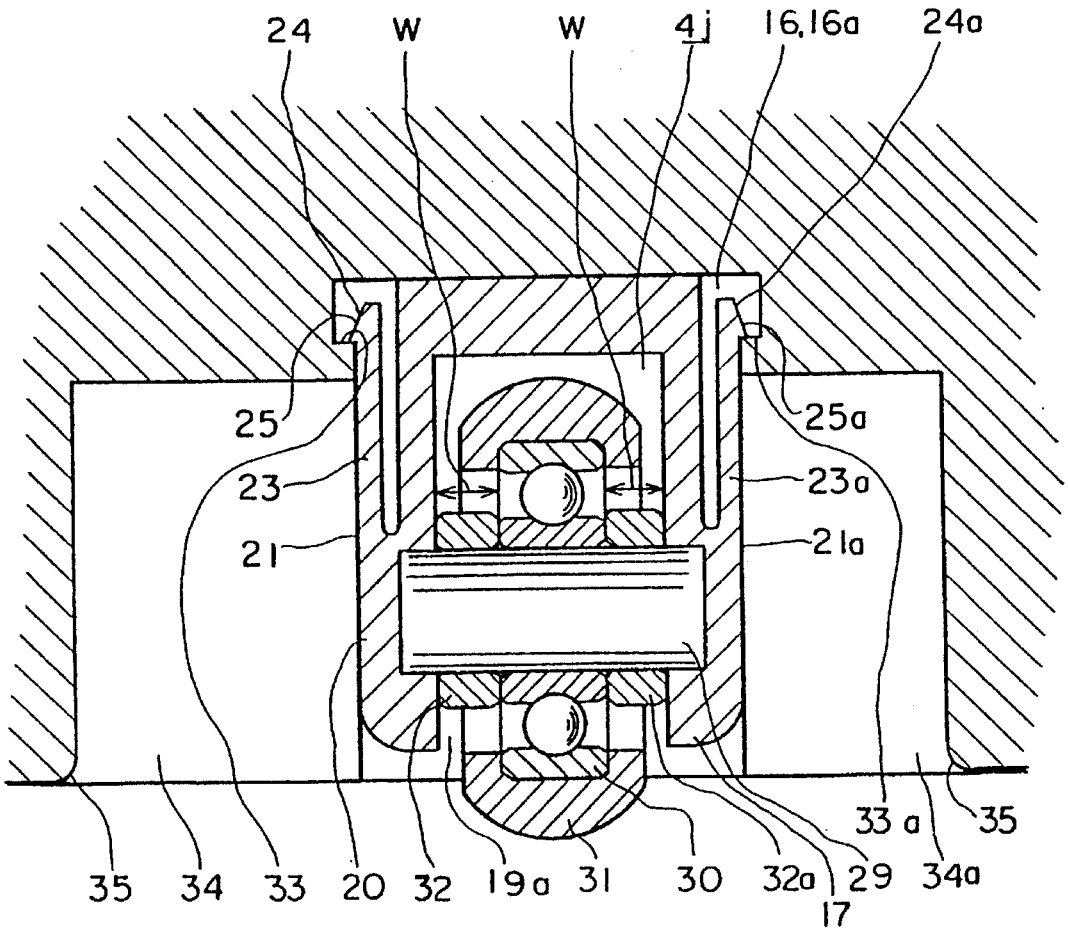
FIG. 27 is a cross sectional view of a rolling member shown in FIG. 26.
Figure 28:
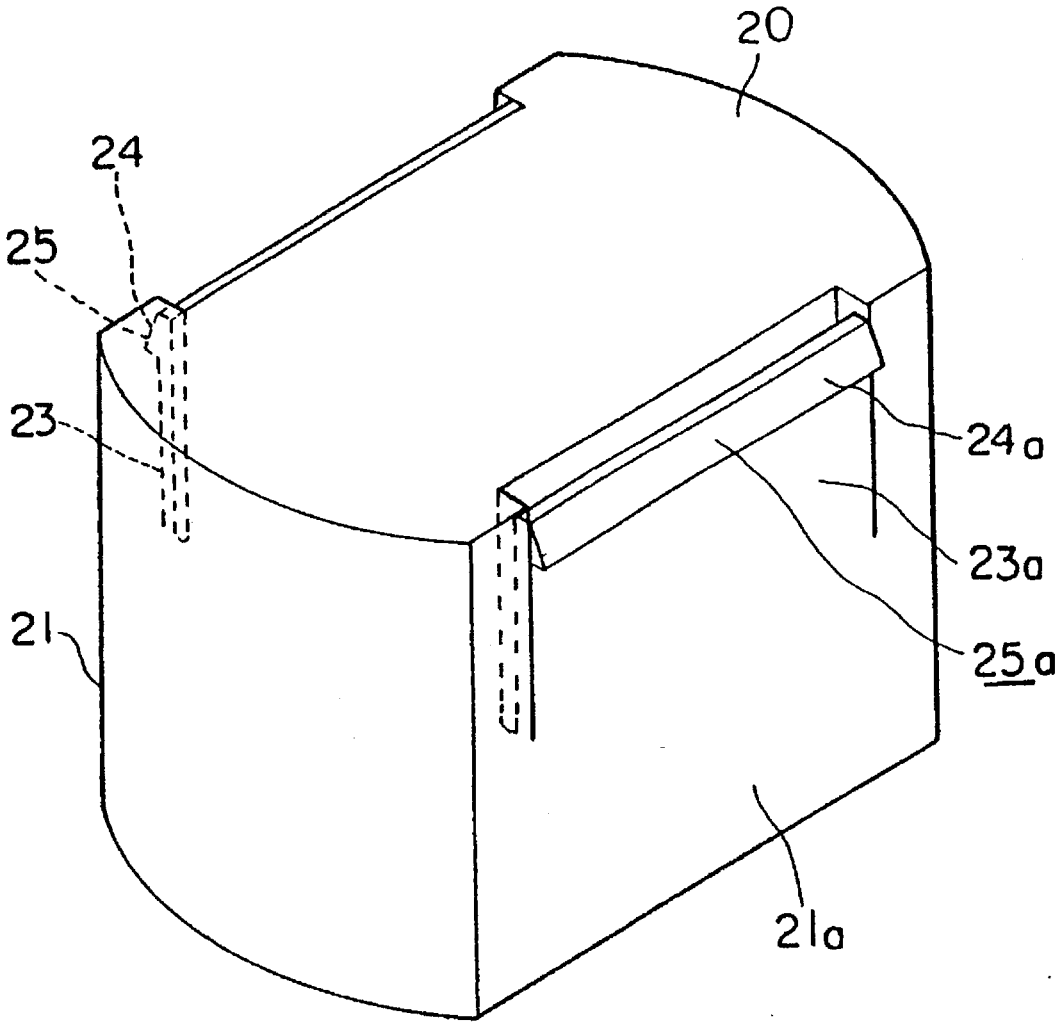
FIG. 28 is an isometric view of a cassette of a rolling member shown in FIG. 26.

The rolling member 4*j* is similar to the first rolling member 4*a*. As shown in FIG. 26 to FIG. 28, the cassette 17 comprises the wheel member 18, 18*a*, the box 20 at the lower end of which the opening 19*a* is formed, the side walls 21, 21*a*, the U-shaped engaging strips 23, 23*a* which are formed at the lower edges of the side walls 21, 21*a*, and the supporting shaft 29 for the wheel member 18, 18*a* which is built horizontally between the side walls 21, 21*a*.

Figure 29:
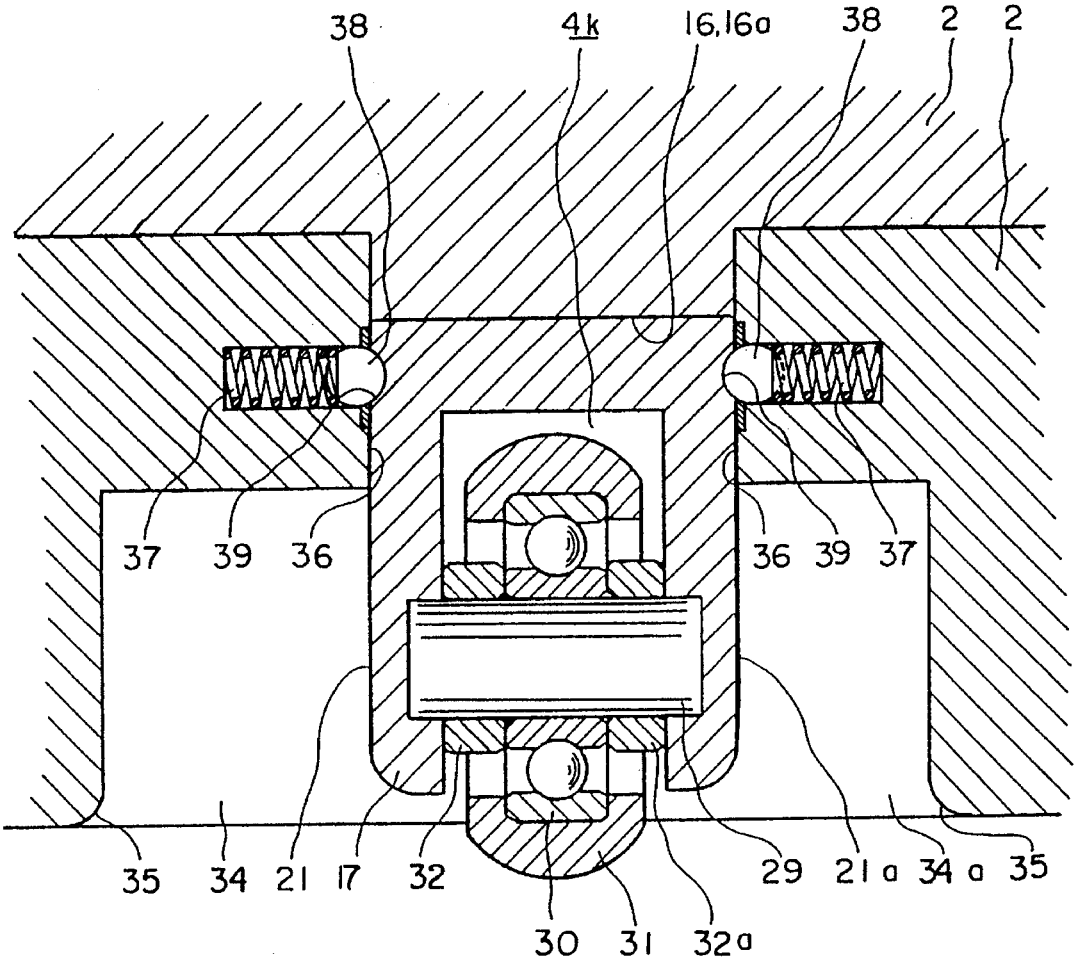
FIG. 29 is a cross sectional view of a rolling member which resembles the second rolling member.
Figure 30:
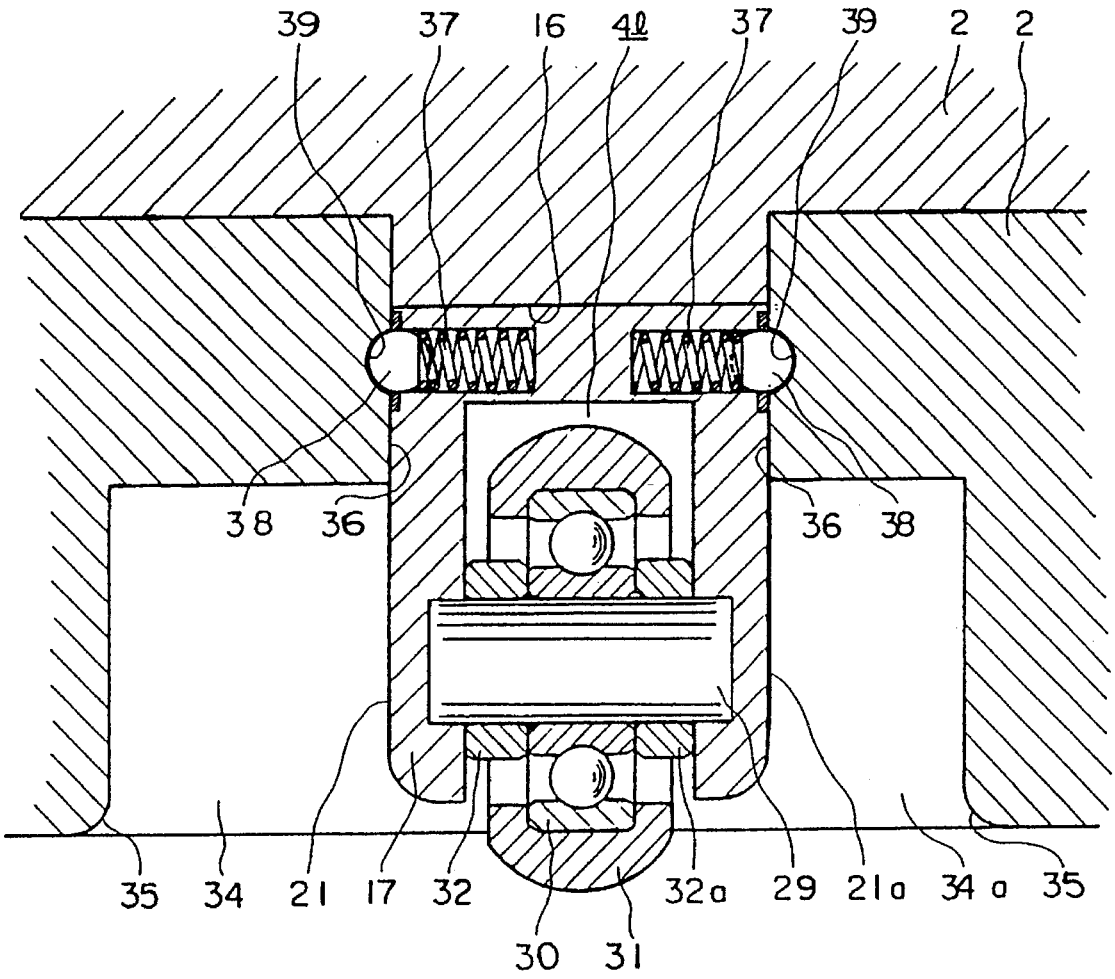
FIG. 30 is a cross sectional view of a rolling member which resembles the third rolling member.
Figure 31:
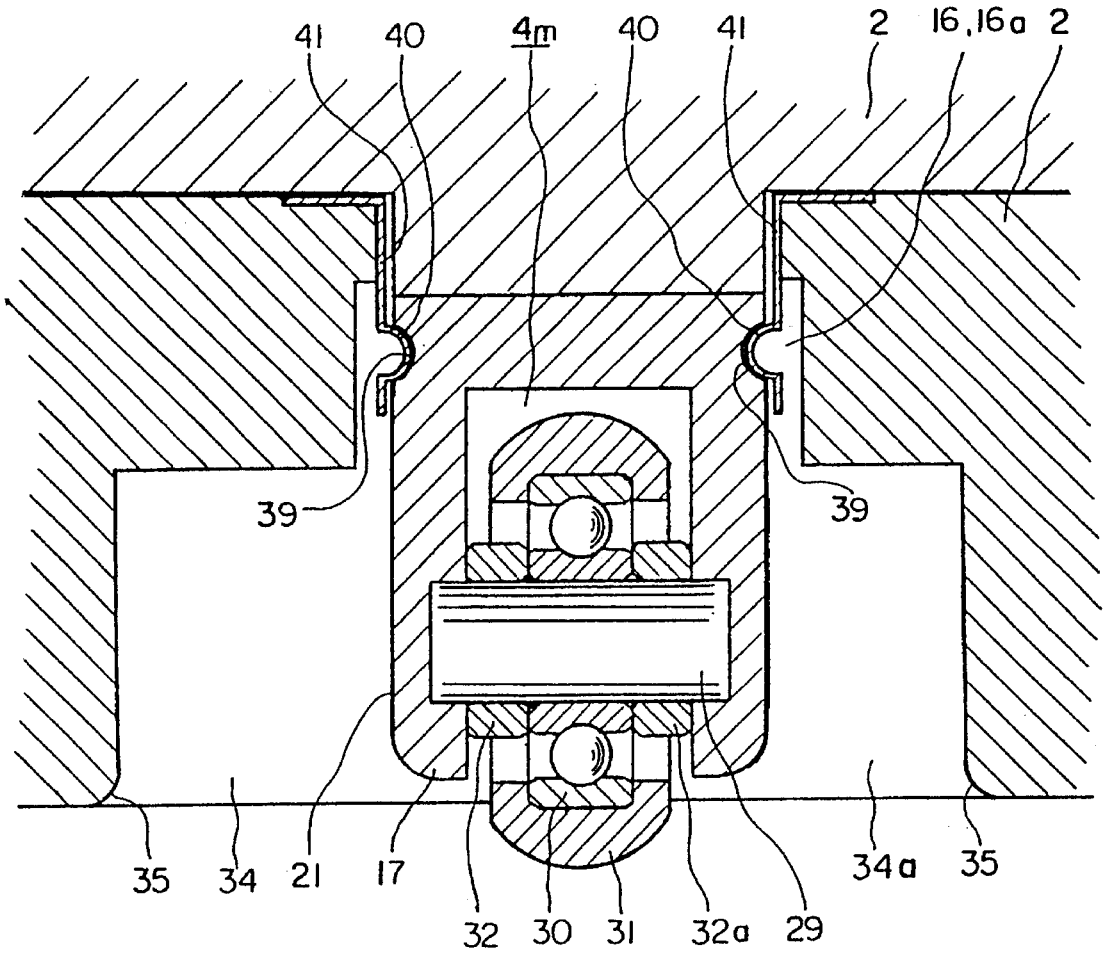
FIG. 31 is a cross sectional view of a rolling member which resembles the fourth rolling member.
Figure 32:
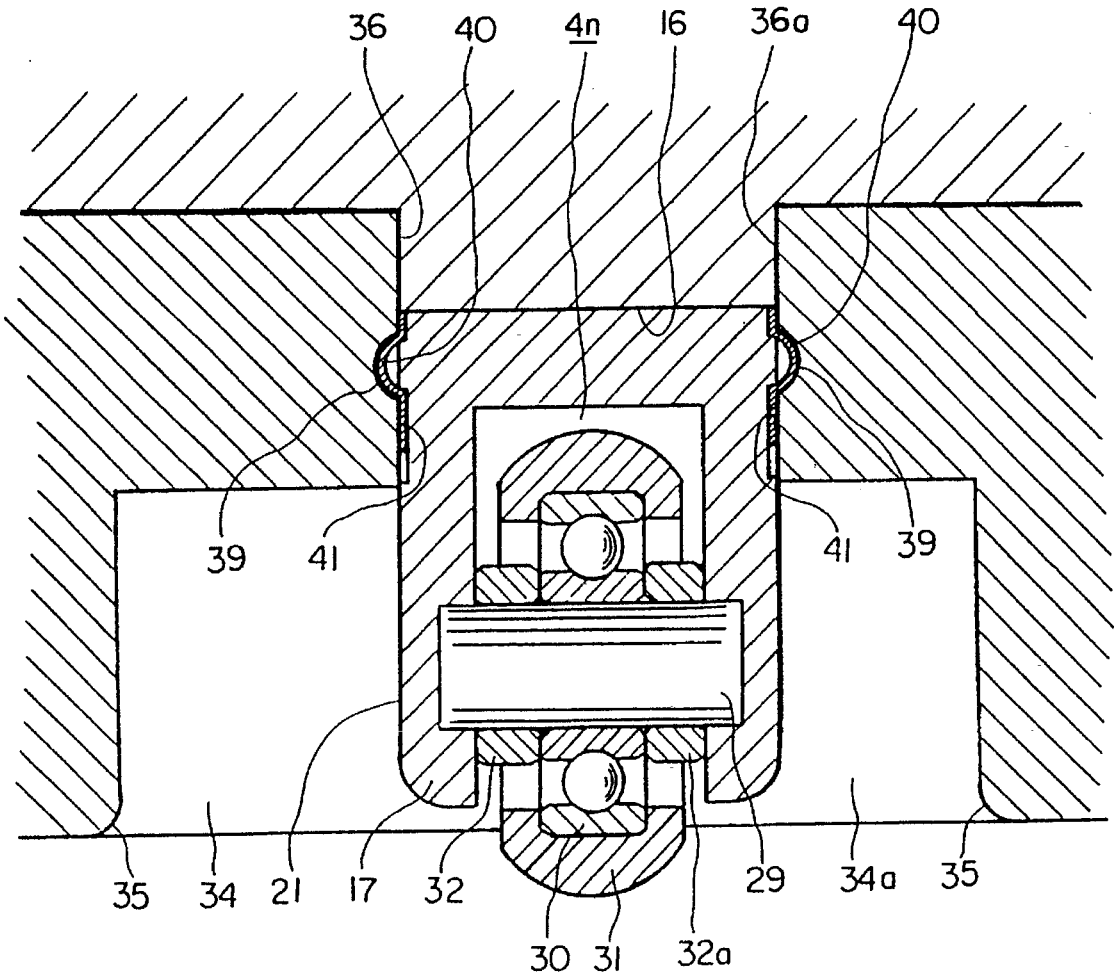
FIG. 32 is a cross sectional view of a rolling member which resembles the fifth rolling member.
Figure 33:
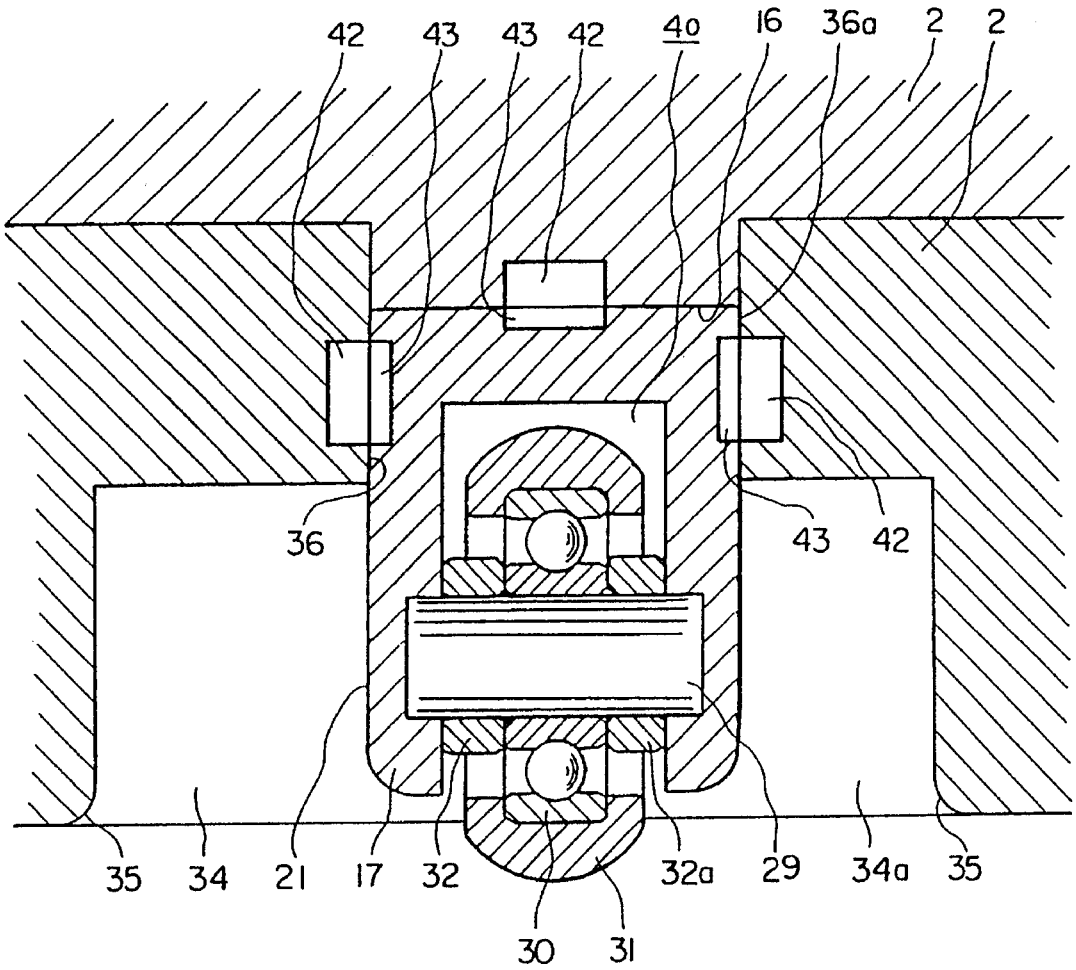
FIG. 33 is a cross sectional view of a rolling member which resembles the sixth rolling member.
Figure 34:
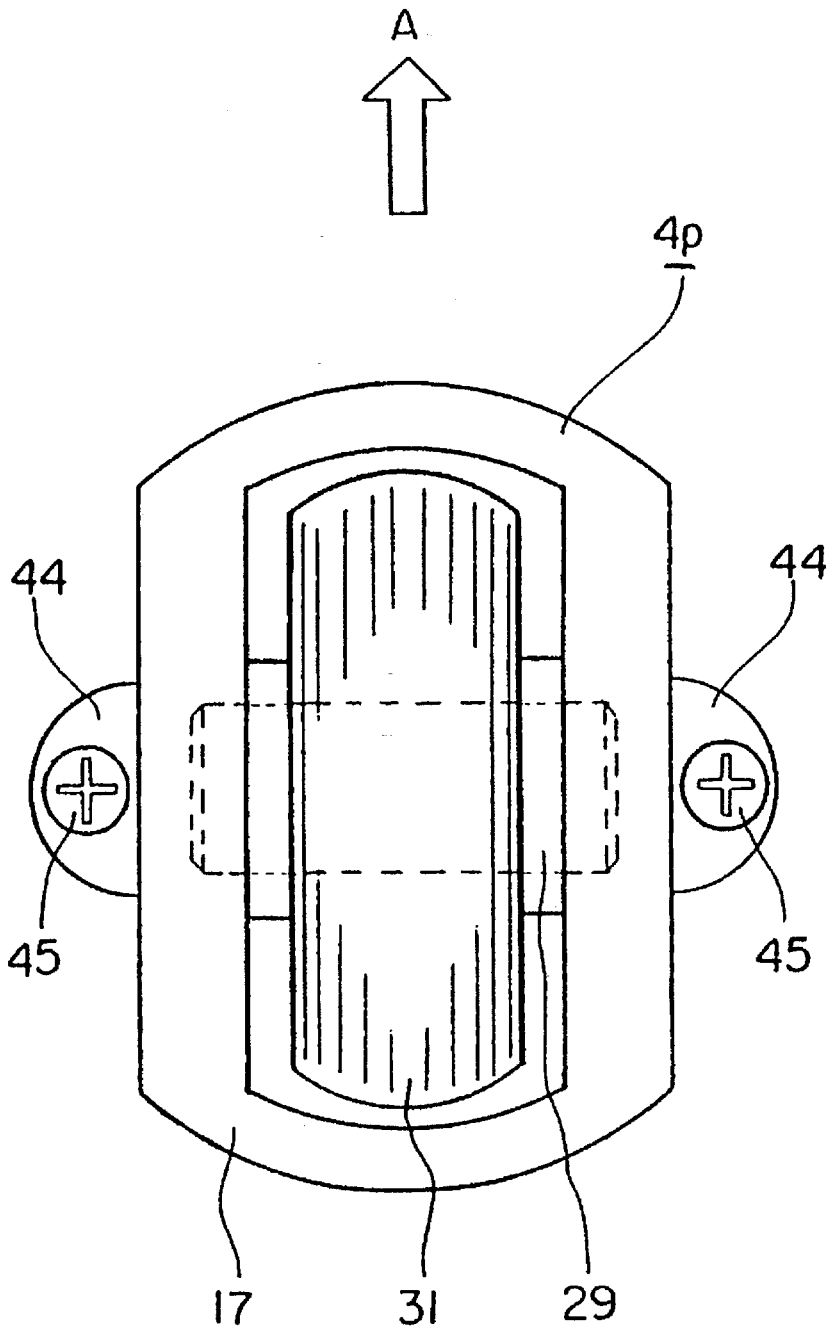
FIG. 34 is a bottom view of a rolling member which resembles the seventh rolling member.

The rolling members 4*k*, 4*l* shown in FIG. 29 and FIG. 30 are respectively similar to the second and third rolling members 4*b*, 4*c*. The rolling members 4*m*, 4*n* shown in FIG. 31 and FIG. 32, which have the engaging strip 41 made of a plate spring, are respectively similar to the fourth and fifth rolling members 4*d*, 4*e*. The rolling member 40 shown in FIG. 33, which has the permanent magnet 42, is similar to the sixth rolling member 4*f*. And the rolling member 4*p* shown in FIG. 34, which has the fixing screws 45, 45*a*, is similar to the seventh rolling member 4*g*.

Figure 35:
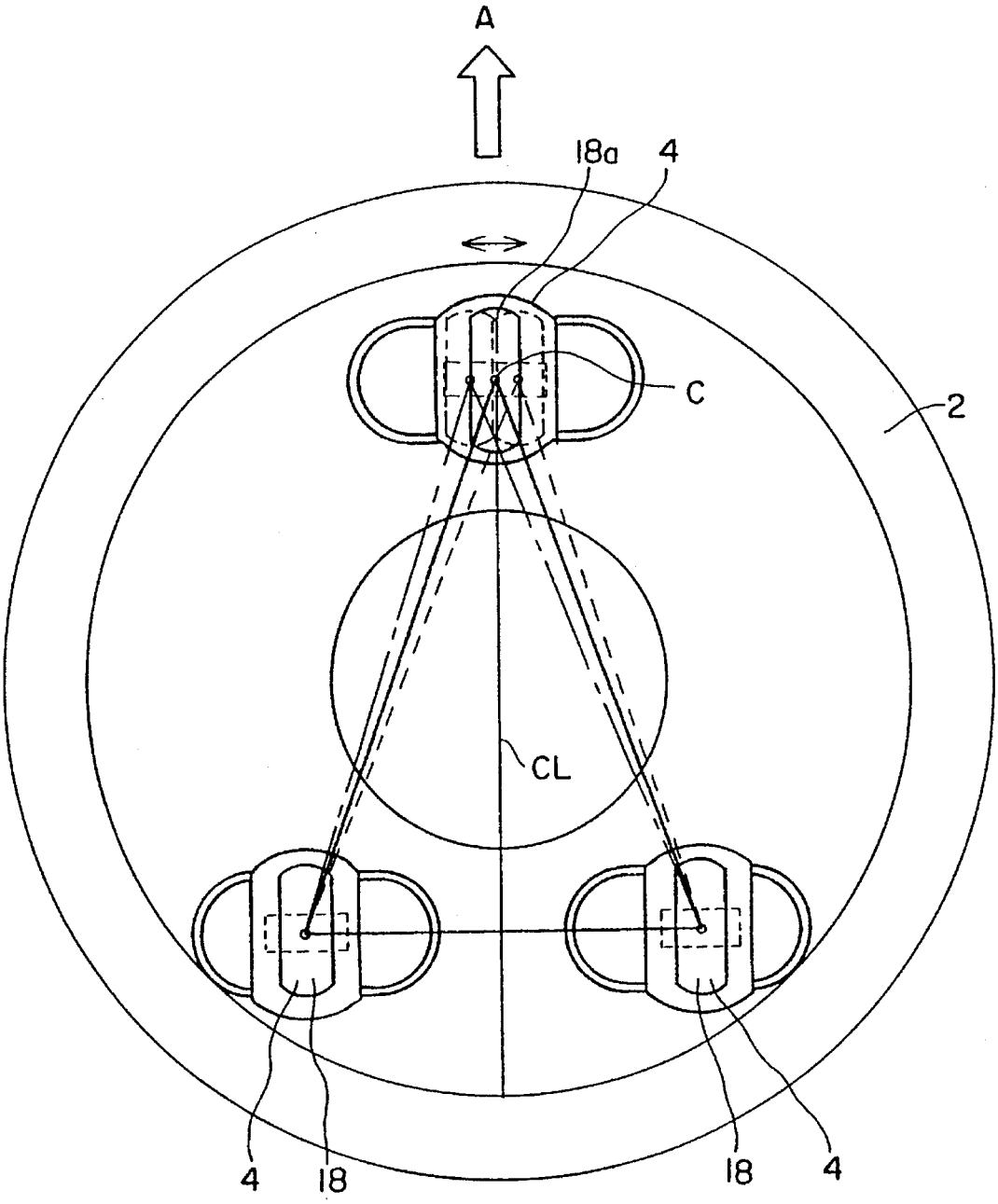
FIG. 35 is a bottom view of a gliding object which shows the position of rolling members which are varied to select the gliding course.
Figure 36:
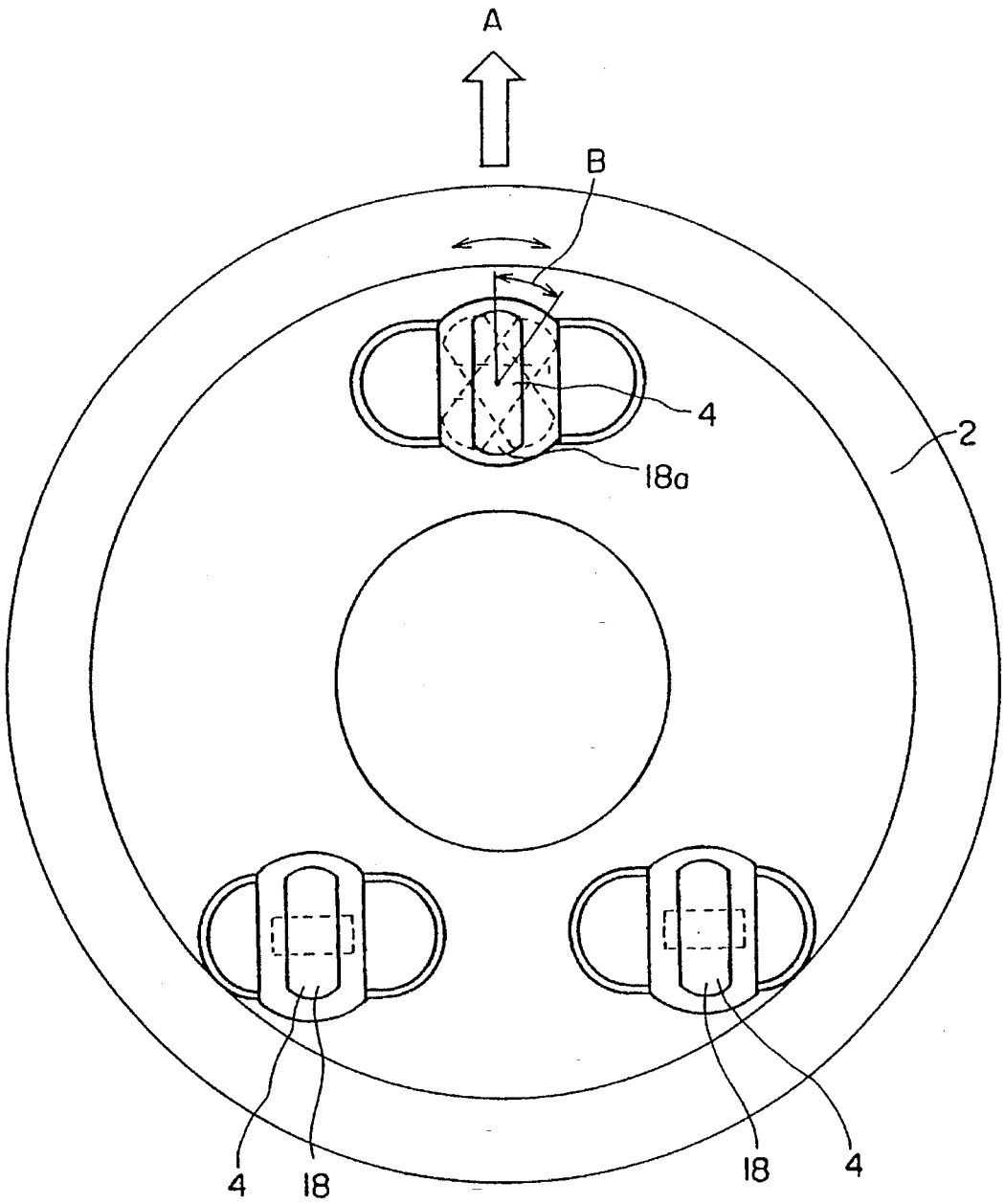
FIG. 36 is a bottom view of another embodiment of a gliding object shown in FIG. 35.
Figure 37:
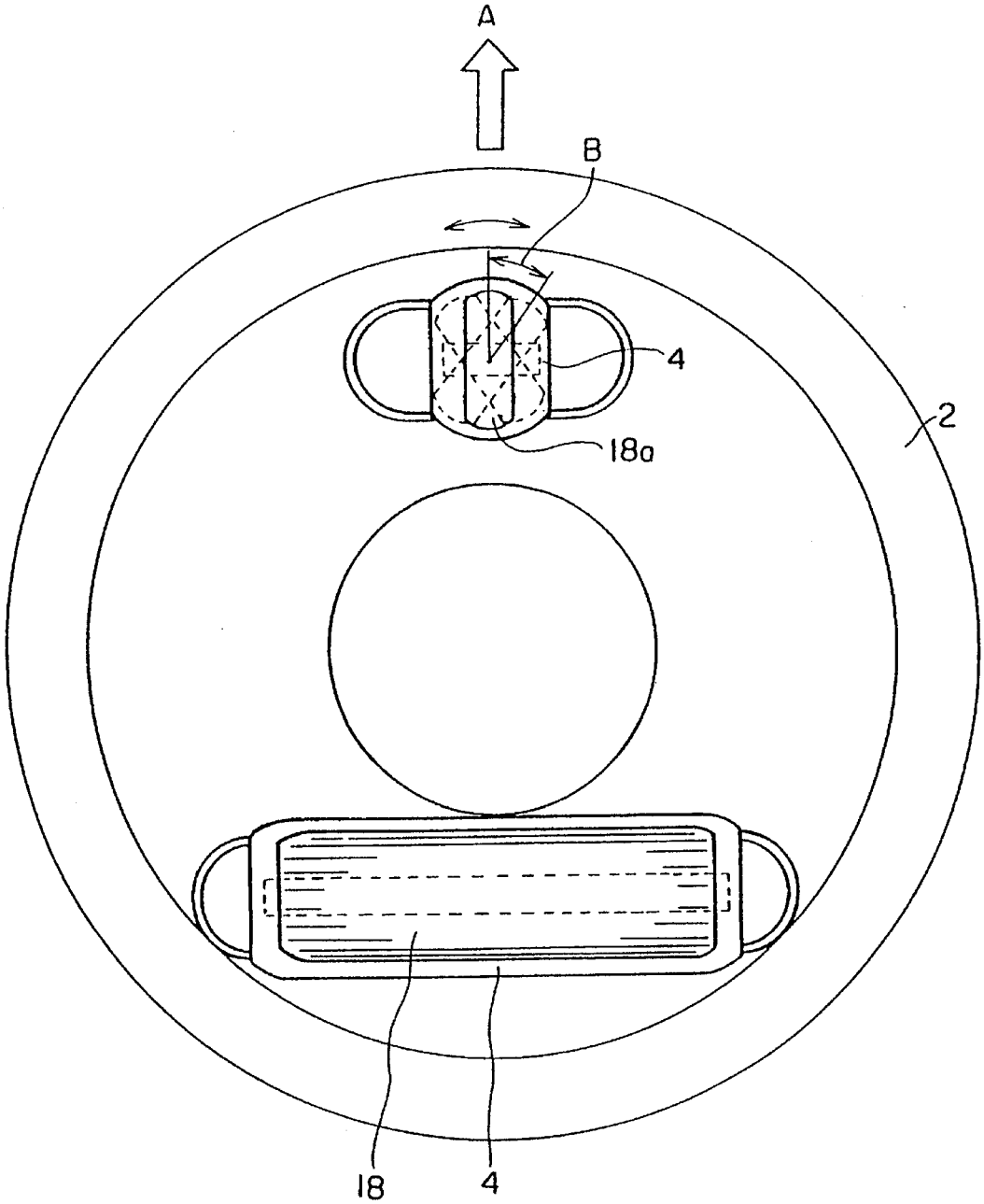
FIG. 37 is a bottom view of another embodiment of a gliding object shown in FIG. 35.

Furthermore, other embodiments wherein the gliding direction of the gliding object 1 is varied are shown in FIG. 35 to FIG. 37. It is possible to move the center C of the wheel member 18*a* of the front rolling member 4 to one side, and to vary the starting pitch B of the wheel member 18*a* by letting the said wheel member 18*a* freely rotate around a vertical line.

Figure 38:
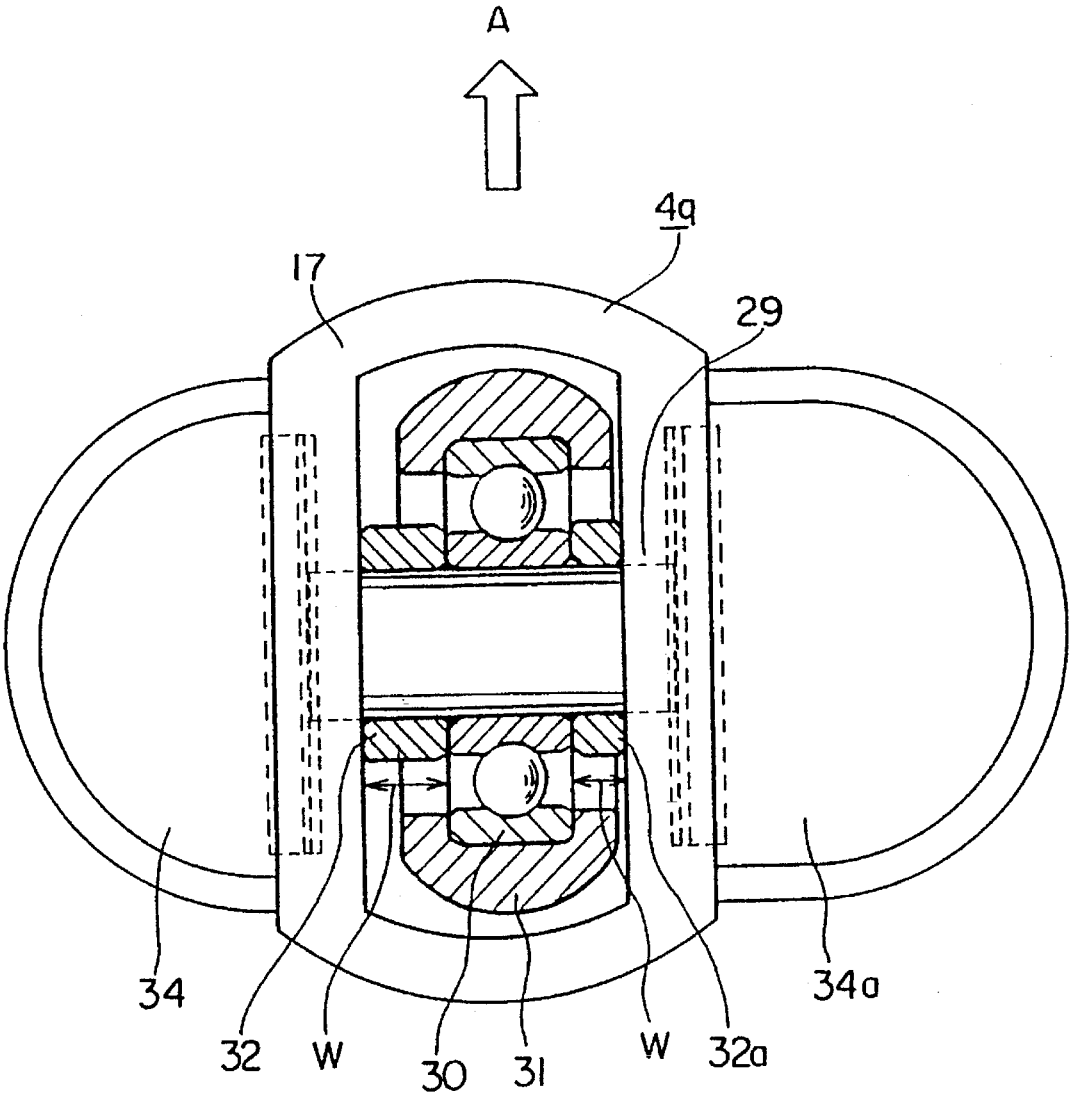
FIG. 38 is a partial cross sectional view of the bottom of the tenth rolling member.

As to an embodiment of the tenth rolling member 4*q* shown in FIG. 38, the position of the wheel member 18*a* of the rolling member 4 is freely moved to the right or left side. The width W of the collars 32, 32*a* which are positioned on the supporting shaft 29 is varied so that the center C of the wheel member 18*a* which is fitted in the detachable cassette 17 is moved to the right or left side of the center line CL between two rear rolling members. The cassette 17 is the same as with the rolling member 4*j*.

Figure 39:
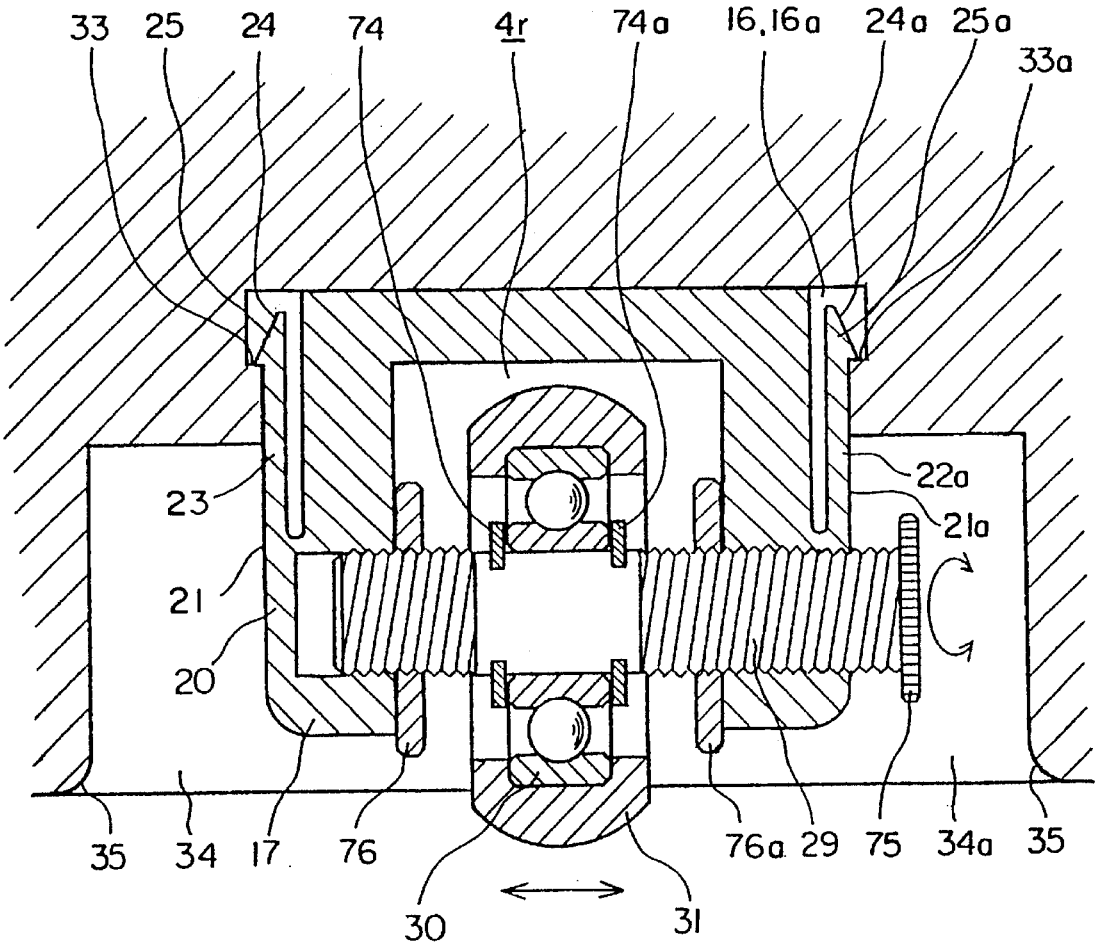
FIG. 39 is a cross sectional view of the eleventh rolling member.

As another embodiment, the eleventh rolling member 4*r* is shown in FIG. 39. The supporting shaft 29, which is built horizontally between the side walls 21, 21*a* of the cassette 17, is inserted and screwed as a screw member into the side walls 21, 21*a*. The wheel 30 is fixed with the retaining rings 74, 74*a* which are positioned on both sides of the nonthread portion of the supporting shaft 29.

Moreover, it is possible to arrange the pincher 75, which has knurls, at an edge of the supporting shaft 29. The diameter of the pincher 75 is greater than that of the supporting shaft 29. At an edge of the supporting shaft 29, it is possible to engrave a hexagonal concave (not illustrated) in which a hexagonal wrench (not illustrated) is fitted. The reference numeral 76, 76*a* represent locking nuts which control the rotation of the supporting shaft 29.

Figure 40:
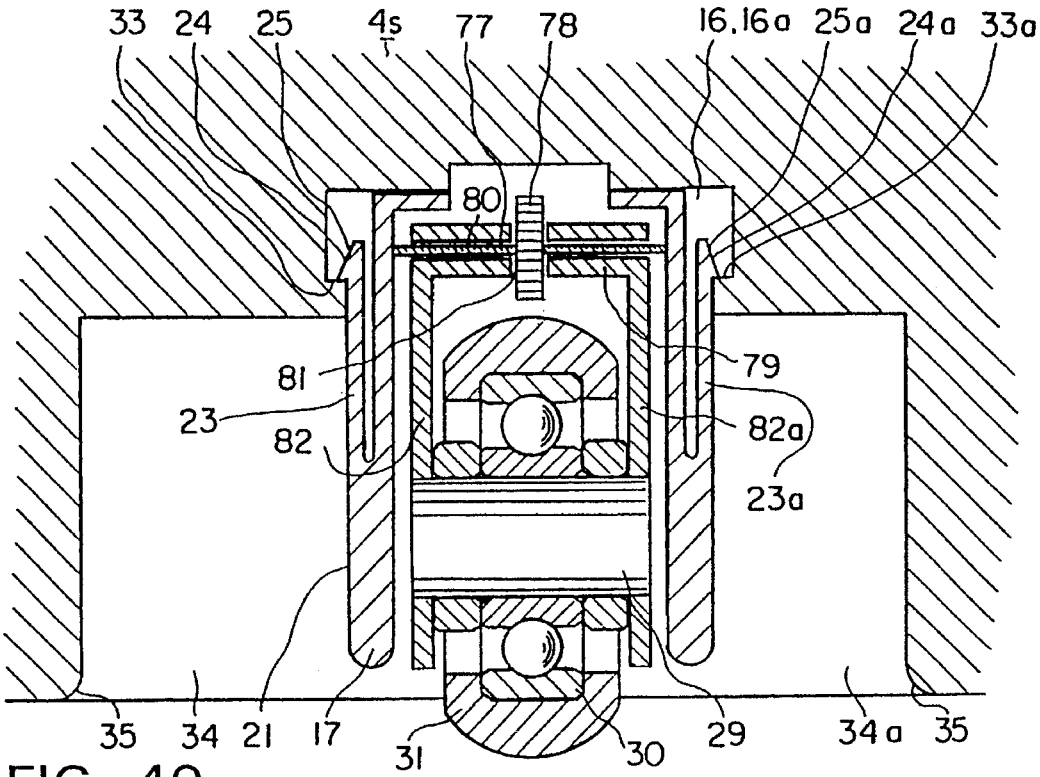
FIG. 40 is a cross sectional view of the twelfth rolling member.
Figure 41:
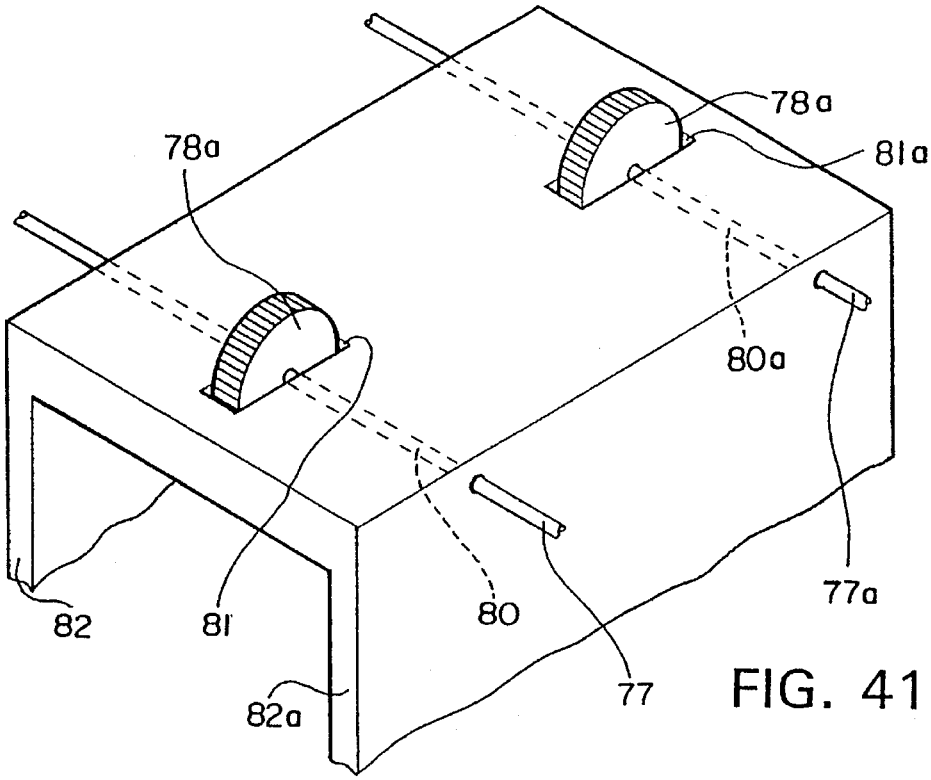
FIG. 41 is an isometric view of a partial structure of the twelfth rolling member shown in FIG. 40.

As another embodiment, the twelfth rolling member 4*s* is shown in FIG. 40 and FIG. 41. The screw shafts 77, 77*a* are horizontally fixed at the front and rear of the cassette 17 between the side walls 21, 21*a*. The moving nuts 78, 78*a* are respectively screwed on the screw shafts 77, 77*a*.

The holes 80, 80*a* are perforated through the front and rear of the plate member 79 which is constructed so as to be smaller than the cassette 17. The screw shafts 77, 77*a* are inserted through the holes 80, 80*a*. The moving nuts 78, 78*a* are idly fitted in the rectangular apertures 81, 81*a* which are formed at the center between the holes 80, 80*a*.

Moreover, the supporting shaft 29 of the wheel 30 is horizontally fixed between the supporting strips 82, 82*a* which are formed so as to extend downwardly from both edges of the plate member 79.

Figure 42:
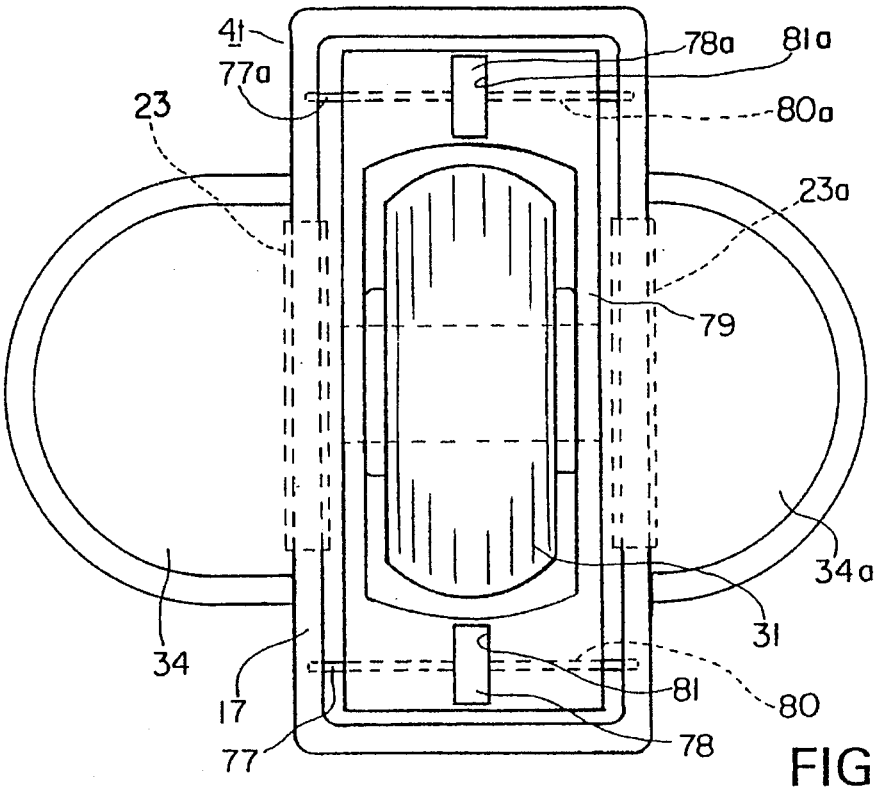
FIG. 42 is a bottom view of the thirteenth rolling member.
Figure 43:
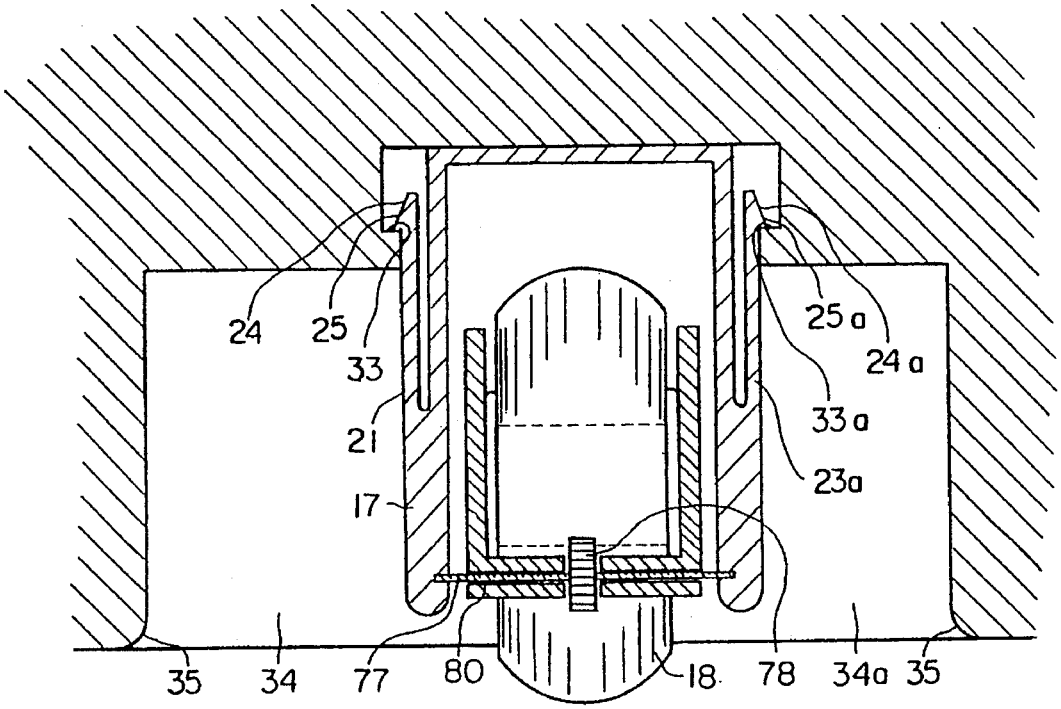
FIG. 43 is a cross sectional view of the thirteenth rolling member shown in FIG. 42.

As another embodiment, the thirteenth rolling member 4*t* is shown in FIG. 42 and FIG. 43. The screw shafts 77, 77*a* are horizontally fixed at the front and rear of the lower opening 19*a* between the side walls 21, 21*a* of the cassette 17 and the screw shafts 77, 77*a* are respectively screwed with the moving nuts 78, 78*a*.

The holes 80, 80*a* are perforated through the front and rear of the plate member 79 which is constructed so as to be smaller than the cassette 17. The screw shafts 77, 77*a* are inserted through the holes 80, 80*a*. The moving nuts 78, 78*a* are idly fitted in the rectangular apertures 81, 81*a* which are formed at the center between the holes 80, 80*a*.

Moreover, the supporting shaft 29 of the wheel 30 is fixed horizontally in the opening which is formed at the center of the plate member 79.

It is possible to fit the extended portions of the cassette 17 in the hollows 16, 16*a* . . . by lengthening the longitudinal measure of the hollows 16, 16*a* . . . . Furthermore, it is possible to adopt other parts whose size is the same as with the wheel member 18 shown in the aforementioned embodiments, or to equip the cassette 17 shown in the aforementioned other embodiments, by arranging the screw shafts 77, 77*a* at the extended portions.

Figure 44:
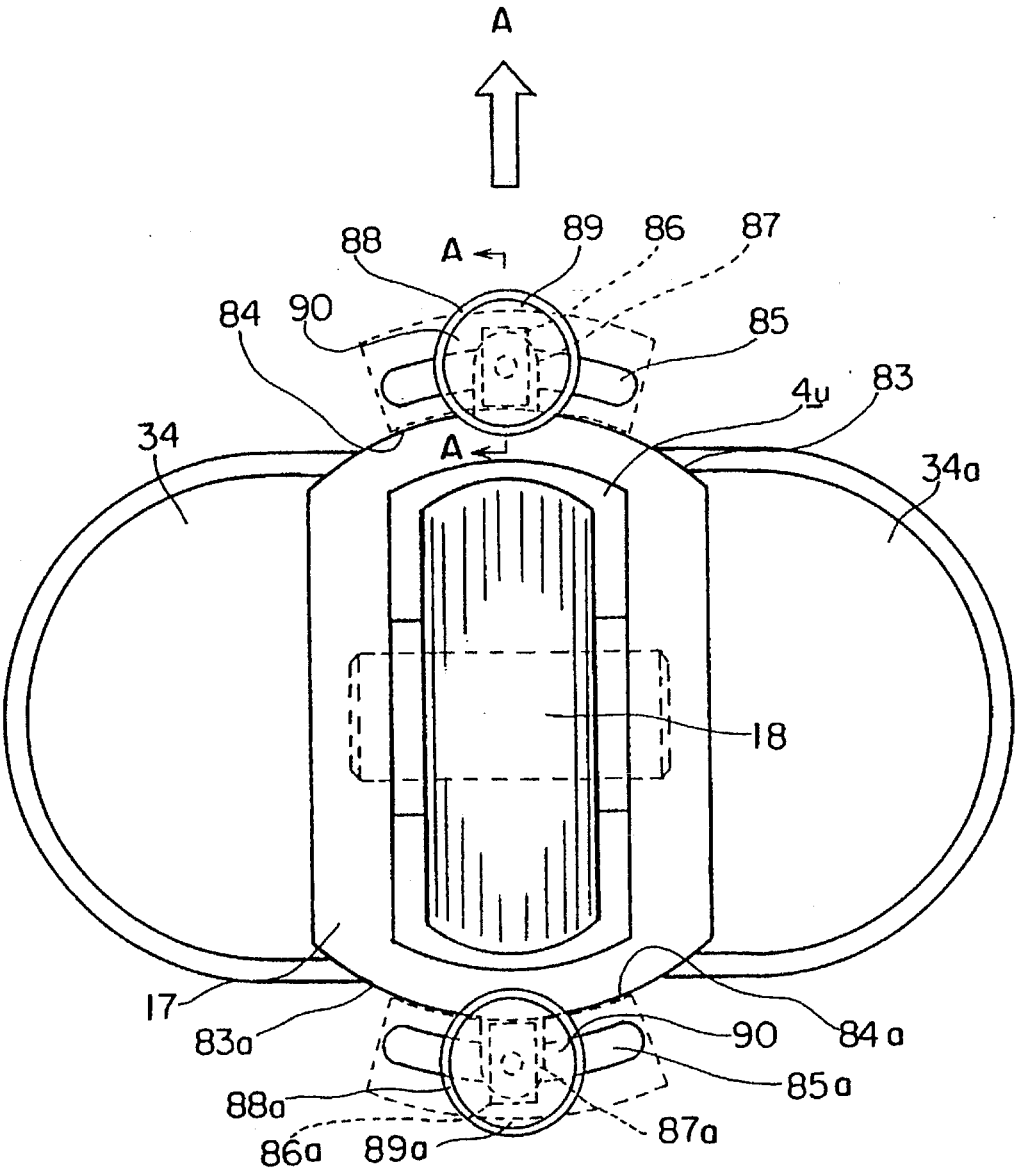
FIG. 44 is a bottom view of the fourteenth rolling member.
Figure 45:
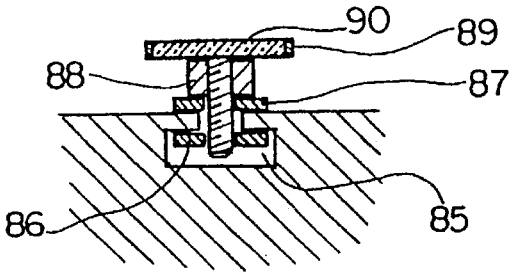
FIG. 45 is a cross sectional view taken along line A—A shown in FIG. 44.

As another embodiment, the fourteenth rolling member 4*u* will be described as follows. As shown in FIG. 44 and FIG. 45, the front and rear walls 83, 83*a* of the cassette 17 are formed as an arc so that the form of the bottom of the cassette 17 is roughly oval and the front and rear walls 84, 84*a* of the hollows 16, 16*a* . . . are also formed as an arc. The cassette 17 is fitted in the hollows 16, 16*a* . . . so as to rotate freely around a vertical line. The guiding arc notches 85, 85*a*, whose cross sectional form is an inverted T-shape, are grooved at the forward and backward positions of the hollows 16, 16*a* . . . on the bottom of the body 2. The moving dice 86, 86*a* are equipped in the guiding notches 85, 85*a* so as to move freely. The supporting projections 87, 87*a* project from the front and rear edges of the cassette 17. The clamp screws 88, 88*a*, which are inserted through the supporting projections 87, 87*a*, are screwed into the moving dice 86, 86*a*.

Moreover, the screw heads 89, 89*a* have knurls which are arranged at the top of the clamp screws 88, 88*a*. The transparent part 90 made of a transparent material is formed at the inside of the screw heads 89, 89*a*.

Figure 46:
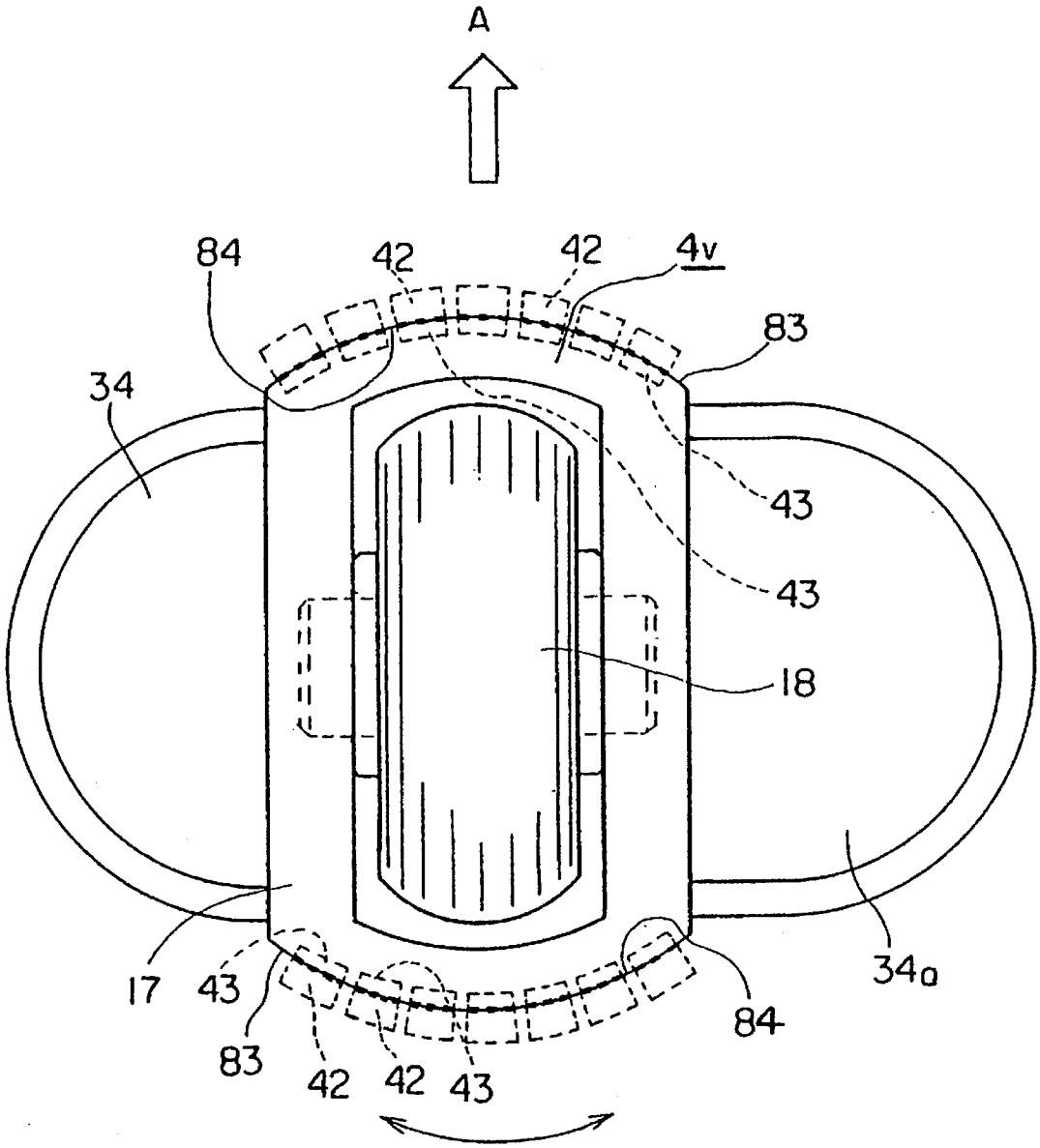
FIG. 46 is a bottom view of the fifteenth rolling member.
Figure 47:
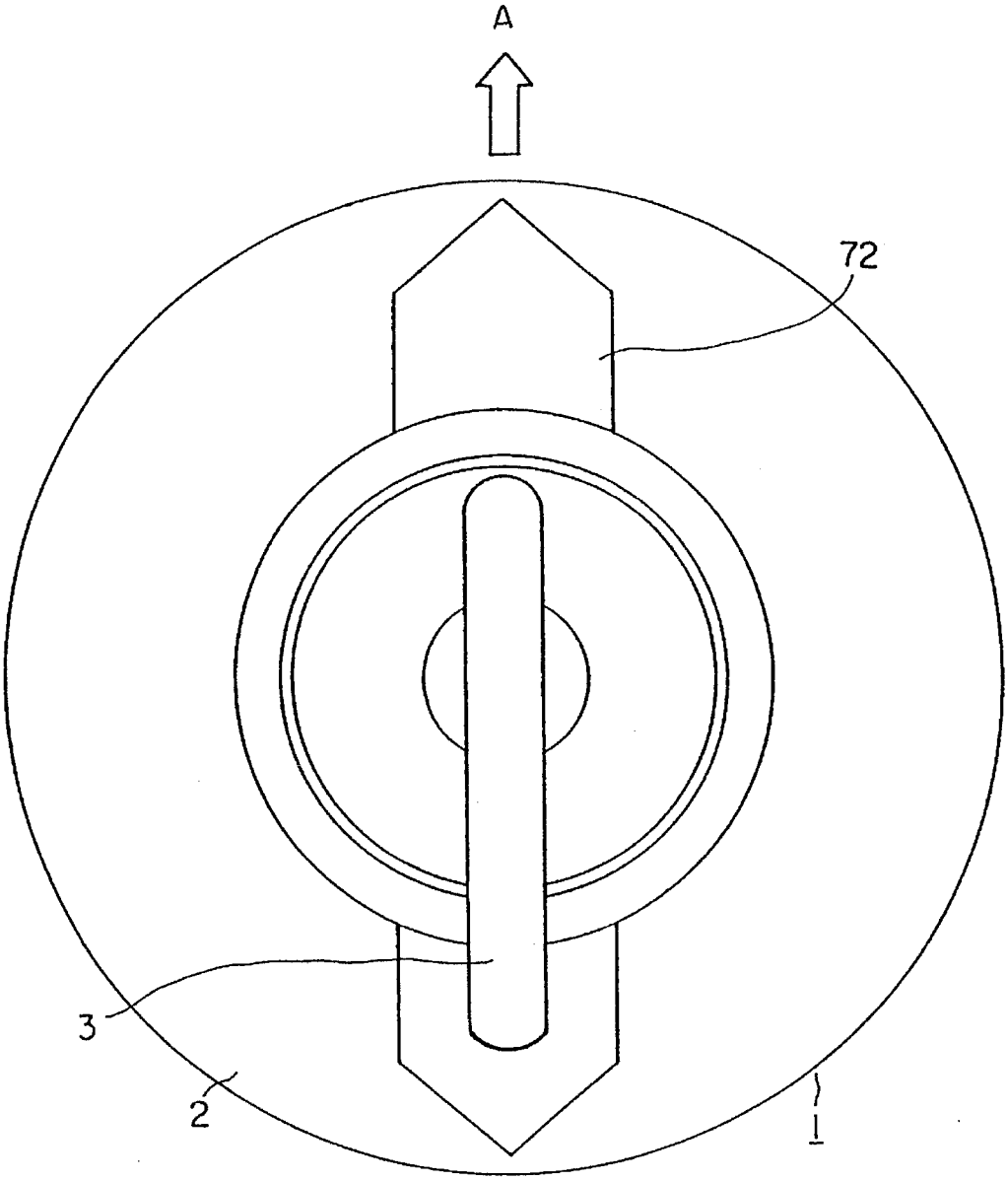
FIG. 47 is a top view of a gliding object.
Figure 48:
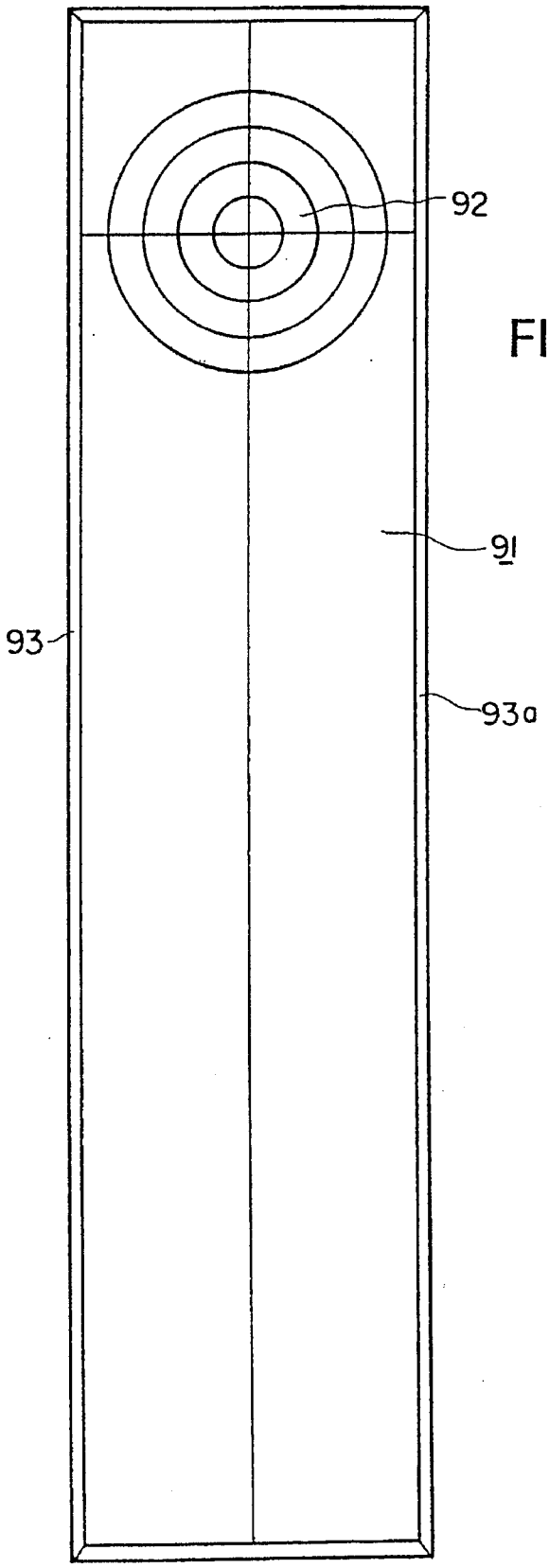
FIG. 48 is a plan view of a rubber sheet.
Figure 49:
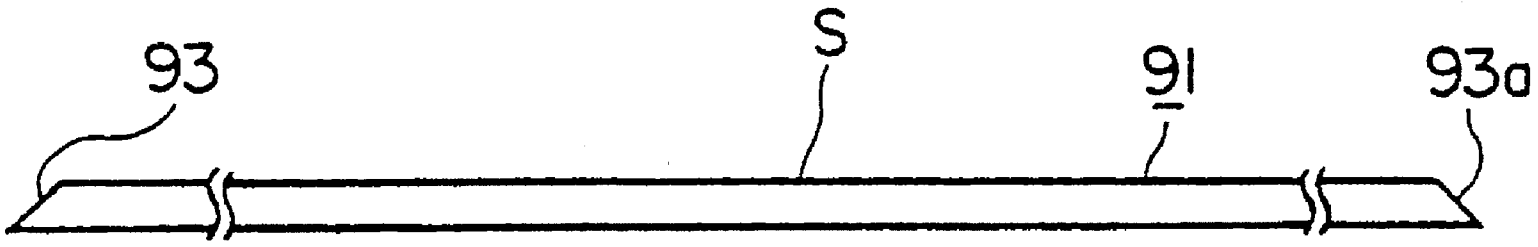
FIG. 49 is a cross sectional view of a rubber sheet shown in FIG. 48.

As another embodiment, the fifteenth rolling member 4*v* will be described as follows. As shown in FIG. 46, the cassette 17 is fitted in the hollows 16, 16*a* . . . so as to rotate freely about a vertical line. The magnetic member 43 or the permanent magnet 42 each is attached at a regular interval to the front and rear walls of the cassette 17 and at suitable positions on the front and rear walls of the hollows 16, 16*a* . . . .

The reference numeral 91 represents a rubber sheet whose surface is smooth and back is rough and which is used in the case of an uneven floor. The rubber sheet 91 comprises the gliding surface S on which the gliding object 1 glides and the tee 92, and is made of a hard gum whose hardness is 80–100 degrees. The edges 93, 93*a* of the rubber sheet 91 are tapered so that players can play safely without stumbling.

Furthermore, an operation of a gliding object for use as recreational sporting goods according to the present invention will be described hereafter.

As to a playing method, a player falls upon one knee, bends his wrist to let his palm face toward the gliding direction A, holds the grip 7 of the handle 3 of the gliding object 1 which is on a floor or the gliding surface S of the rubber sheet 91, and pushes his hand forward to glide the object 1 at the tee 92. The gliding object 1 impulses the other objects which belong to the player's own or another team. A player throws the gliding object 1 at the tee 92, enjoying the metallic sounds of impulse. At last, a team which has more stones in the score zone (concentric circles) can be a winning team.

The grip 7 of the handle 3 is inclined downward so that a player can subtly adjust the force, which is given to the object 1 for gliding at the tee 92, by pressing his palm to the grip 7.

Moreover, a method of detaching the rolling members 4*a*, 4*j* is to insert fingers in the spaces 34, 34*a* and press the flexible strips 23, 23*a* of the cassette 17 to release the engagement of the pawls 25, 25*a* and the stages 33, 33*a*. At the time of fitting the rolling members 4*a*, 4*j*, the pawls 25, 25*a* of the bended strips 23, 23*a* are inserted in the stages 33, 33*a*, and then the bended strips 23, 23*a* are restored so that the pawls 25, 25*a* and the stages 33, 33*a* are firmly engaged.

A method of detaching the rolling members 4*b*, 4*c*, 4*k*, 4*l* is to insert fingers in the spaces 34, 34*a*, hold and pull out the cassette 17 to move the ball 38 against the spring 37 so that the engagement of the ball 38 and the fitting dent 39 is released. At the time of fitting the rolling members 4*b*, 4*c*, 4*k*, 4*l* in the hollows 16, 16*a* . . . , the ball 38 is pushed by the spring 37 so as to engage with the fitting dent 39.

A method of detaching the rolling members 4*d*, 4*e*, 4*m*, 4*n* is to insert fingers in the spaces 34, 34*a*, hold and pull out the cassette 17, and bend the flexible plate 41 to release the engagement of the dent 39 and the projection 40. At the time of fitting the rolling members 4*d*, 4*e*, 4*m*, 4*n* in the hollows 16, 16*a* . . . , the bended plate 41 is inserted in the hollows 16, 16*a* . . . and then restored so that the projection 40 is touched and engaged with the dent 39.

A method of detaching the rolling members 4*f*, 4*o* is to insert fingers in the spaces 34, 34*a*, hold the cassette 17, and pull it out against the attraction of the permanent magnet 42. At the time of fitting the rolling members 4*f*, 4*o* in the hollows 16, 16*a* . . . , the magnetic member 43 of the cassette 17 is attracted by the permanent magnet 42 of the hollows 16, 16*a* . . . .

A method of detaching the rolling members 4*g*, 4*p* is to loosen the screws 45, 45*a*. At the time of fixing the rolling members 4*g*, 4*p*, the screws 45, 45*a* are inserted through the projection 44 and screwed into the female screw bore of the body 2.

Furthermore, adjustment of the courses through which the object 1 glides at the tee 92 and corresponding with the gliding direction A will be described as follows. As to the gliding object 1 wherein the rolling member 4 is positioned in the three-form, the rolling member 4 comprising the wheel member 18*a* is equipped in the front hollow 16, corresponding with the gliding direction A. The wheel member 18*a* comprises the tire 31 which is freely banked to the right or left side by fixing the supporting shaft 29 oblique with respect to a horizontal line. A method of gliding the object 1 at the right side of the gliding direction A is to bank the tire 31 of the wheel member 18*a* to the right side, fit the wheel member 18*a* in the cassette 17 and then equip the cassette 17 in the hollow 16. That is how the center of gravity of the gliding object 1 leans to the right side so that the object 1 glides, thereby drawing a slice line.

A method of gliding the object 1 at the left side of the gliding direction A is to bank the tire 31 of the wheel member 18*a* to the left side, fit the wheel member 18*a* in the cassette 17 and then equip the cassette 17 in the hollow 16. That is how the object 1 glides to draw a hook line.

Moreover, there are various degrees at which the gliding object 1 curves because the tire 31 is freely banked. Therefore, it is possible to exchange the various wheel members 18*a* whose banked pitches are different.

As to the wheel member 18*a* having the supporting shaft 29 whose obliquity to a horizontal line is adjustable, the supporting shaft 29 is swung vertically by loosening the nut 51 which is screwed on the long bolt 49. As to other embodiments of the wheel member 18*a*, the supporting shaft 29 is swung vertically by projecting the screws 57, 57*a* equally. As a result, it is possible to bank the tire 31 suitably so that the object 1 glides on a straight, slice or hook line corresponding to the gliding direction A.

Although the tire 31 is banked to adjust the gliding direction of the object 1 as mentioned above, there are other methods to regulate the gliding direction. It is possible to let the gliding object 1 have a function of straight gliding or to vary the tire 31 by other methods apart from inclination.

An embodiment in the case of gliding the object 1 straight, forwardly is shown in FIG. 35 etc. The selected rolling member 4 is equipped in the front and the rear sides of the bottom of the body 2. The center C of the front rolling member 4 whose position is fixed is aligned with the center line CL between the rear rolling member 4. The center C of the wheel member 18*a* of the front rolling member 4 whose position is adjustable is aligned with the center line CL between the rear rolling member 4.

Other method of gliding the object 1 through a slice or hook line is to move the center C of the front rolling member 4 to the right or left side of the center line CL between the back rolling member 4.

For example, in the case of the tenth rolling member 4*q*, the collars 32, 32*a* are provided whose width are different. That is why it is possible to glide the object 1 through a slice or hook line by moving the rolling member 4*q* laterally. In the case of the eleventh rolling member 4*r*, the locking nuts 76, 76*a* are loosened to let the supporting shaft 29 rotate freely, and then the pincher 75 is rotated to screw the supporting shaft 29 so that the wheel member 18*a* is moved to the right or left side. As a result, the object 1 glides through a slice or hook line.

In case of the twelfth and thirteenth rolling members 4*s*, 4*t*, the moving nuts 78, 78*a* are moved to the right or left side along the shaft direction of the screw shafts 77, 77*a* and consequently, the plate member 79 is also moved in the same direction. The center C of the wheel member 18*a* which is supported with the supporting strips 82, 82*a* is banked to the right or left side.

Moreover, the starting pitch B of the wheel member 18*a* of the front rolling member 4 is varied as shown in FIG. 36 and FIG. 37. For example, in the case of the fourteenth rolling member 4*u*, the engagement of the supporting projections 87, 87*a* of the cassette 17 and the moving dice 86, 86*a* is released by loosening the clamp screws 88, 88*a*. Therefore, it is possible to regulate the stating pitch B of the wheel member 18*a* suitably by putting fingers into the spaces 34, 34*a*, holding the cassette 17, rotating the cassette 17 in the suitable direction and then screwing the loosened clamp screws 88, 88*a*. As a result, the object 1 glides through a slice or hook line.

In the aforementioned embodiments, it is possible to freely adjust the starting pitch B.

As to the fifteenth rolling member 4*v*, the adjusting method is to put fingers into the spaces 34, 34*a*, hold the cassette 17, rotate the cassette 17 against the permanent magnet 42, and then release the cassette 17 at a suitable position so that the magnetic member 43 is attracted by the permanent magnet 42. As a result, the object 1 glides, thereby drawing the hook line HL or the slice line SL.

A gliding object for use as recreational sporting goods according to the present invention comprises the body 2 at the front and rear of the bottom of which the hollows 16, 16*a* . . . are formed, and the rolling member 4 which is detachably fixed in the hollows 16, 16*a* . . . and has the wheel members 18, 18*a*. As a result, it is possible to exchange the detachable rolling member 4 quickly, in the case where there are shortcomings such as poor gliding efficiency of the gliding object 1 due to the load of the gliding object 1 acting directly on the wheel members 18, 18*a* when the object 1 is kept in custody or fallen down and in consequence, a slight swing occurs when the tire 31 rotates on the gliding surface S.

Furthermore, a part pressed with the hand is arranged on the upper portion of the body 2 so that a player can throw the gliding object 1 steadily in a natural posture. In addition, the body 2, which has no pressed part, is very handy for transportation or packing.

Moreover, it is possible to play easily in suitable places such as a gymnasium, corner of a factory, or a corridor without requiring an ice rink, wax, preparation, etc. because the rolling member 4 of the object 1 rotates smoothly and lightly on the gliding surface S.

And furthermore, the engaging stages 33, 33*a* are formed in the hollows 16, 16*a* . . . , and the spaces 34, 34*a* are arranged at both sides of the hollows 16, 16*a* . . . . On one hand, the engaging strips 23, 23*a* are arranged at the side walls 21, 21*a* of the cassette 17 in which the wheel members 18, 18*a* are fitted. The fastening pawls 25, 25*a* are formed at the upper portions of the strips 23, 23*a*. The rolling member 4 unitedly comprises the cassette 17. With such a structure, it is possible to detachably fix the cassette 17 of the common rolling member 4 to the body 2 by putting fingers into the spaces 34, 34*a* and holding the cassette 17.

As to an embodiment wherein the tire 31 of the wheel member 18*a* of the rolling member 4 is banked, it is possible to select a slice or hook line as the gliding course of the object 1. In the case of the rolling member 4 which is positioned to be the three-wheel form, it is possible to improve the stability of the object 1 by the three-point support, to regulate the gliding course by adjusting one of the rolling members 4. In another embodiment, the tire 31 of the wheel member 18*a* of the front rolling member 4 is banked, or the center C of the wheel member 18*a* of the front rolling member 4 is moved to the right or left side of the center line CL between the side rolling member 4, or the starting pitch B of the wheel member 18*a* of the front rolling member 4 is varied. As a result, it is possible to select the best structure with respect to improving the stability of the object 1, fixing the wheel member 18*a* firmly, and choosing the gliding course. The banked degree of the tire 31 of the rolling member 4, the width at which the wheel member 18*a* is moved, and the starting pitch B of the wheel member 18*a* are freely regulated. As a result, it is possible to select widely the throwing course (straight, hook, slice, etc.) during a game, and to subtly adjust the throwing course. Furthermore, it is possible to execute the selection of the throwing course and the subtle adjustment quickly and smoothly, and to vary a game because the rolling member 4 is detachable.

Although the invention has been described in its preferred form with a certain degree of particularity, it is to be understood that the present invention is not limited in practical application to the specific embodiments described herein and many changes and variations are possible in the invention without departing from the scope and spirit therefore.

What is claimed is:

1. A gliding object for use in a recreational sporting game comprising:

a body having a top and bottom surface, each surface having a front and rear end;

hollows formed in the body through the bottom surface and positioned toward the front or rear ends of said bottom surface;

rolling units each received within one of the hollows and having a cassette and a wheel member rotatably secured within said cassette, said wheel member adapted to project a predetermined distance below said bottom surface and below said cassette for rolling contact with a playing surface when said rolling unit is received within one of said hollows, each said cassette being positioned within a respective hollow, and mounting means being provided for detachably engaging said rolling unit with said body upon insertion of said rolling unit into said hollow, said mounting means including a resilient detent arrangement coacting between said body and said cassette and disposed within said hollow; and each said hollow defining an access space adjacent at least one side of said cassette to access said cassette for releasably detaching said rolling unit from said body.

2. A gliding object as defined in claim 1, wherein said body includes a handle part for pressing by the hand of a user to propel the gliding object forwardly, said handle part arranged on an upper portion of the body.

3. A gliding object as defined in claim 1, wherein said wheel members each include a tire provided for contact with the playing surface, at least one of said wheel members of said rolling units being banked in an inclined position to define a gliding path over which said gliding object will travel when propelled by a user.

4. A gliding object as defined in claim 1, wherein three of said rolling units are provided and positioned to be in a three wheel form with said wheel member of one of said rolling units having a center which is disposed laterally to the right or left side of a center line oriented intermediate the other two of said rolling units and between said front and back ends, said other two of said rolling units being positioned equal distances from said center line on opposite sides thereof, said wheel member of said one roller unit being banked in an inclined position to define a gliding path over which said gliding object will travel when propelled by a user.

5. A gliding object as defined in claim 1, wherein three of said rolling units are provided and positioned to be in a three wheel form, said wheel member of at least one of said rolling units being pivoted about a vertical axis to define a starting pitch for said wheel member which is varied to vary a gliding path over which said gliding object will travel when propelled by a user.

6. A gliding object as defined in claim 1, wherein at least one of said roller units includes adjustment means so that it is possible to bank a tire of the rolling units about a horizontal axis toward either side thereof, to adjust the wheel member in a sideways direction, or to vary a rotatable position of the wheel member about a vertical axis to define a starting pitch for the wheel member.

7. A gliding object as defined in claim 1, wherein said body includes engaging shoulders which are formed in said body within said hollows, said cassettes having opposing side walls and said wheel member rotatably engaged therein between said side walls, said resilient detent arrangement comprising elastic engaging strips which are integrally formed with both side walls of said cassettes, said elastic engaging strips including fastening pawls which are formed at an upper portion thereof and are adapted to resiliently engage said engaging shoulders when said rolling unit is inserted within said hollow.

8. The gliding object as defined in claim 1, wherein said cassette has an outer surface and said hollow in said body is defined by an inner surface, said outer and inner surfaces being mutually adjacent when said cassette is received within said hollow, said resilient detent arrangement comprising a spring biased projection adapted to project from one of said mutually adjacent surfaces and a projection receiving recess in the other of said mutually adjacent surfaces adapted to seat said projection and keep said cassette from falling out of said hollow.

9. A gliding object as defined in claim 1, wherein said cassette is a substantially rectangular sleeve and said respective hollow defines at least two said access spaces disposed adjacent opposite sides of said sleeve to access said sleeve for releasably detaching said rolling unit from said body.

10. A gliding object for use as recreational sporting goods comprising:

a body having a top and bottom surface, each surface having a front and rear end;

hollows formed in the body through the bottom surface and positioned toward the front or rear ends of said bottom surface; and rolling units each received within one of the hollows and having a cassette and a wheel member rotatably secured within said cassette, said wheel member adapted to project a predetermined distance below said bottom surface and below said cassette for rolling contact with a playing surface when said rolling unit is received within one of said hollows, each said cassette being positioned within a respective hollow, and mounting means being provided for engaging said rolling unit with said body when said rolling unit is disposed within said hollow, at least one of said rolling units including adjustment means for selectively adjusting the arrangement of said wheel member thereof relative to the other of said rolling units to selectively vary a gliding path over which said gliding object travels when propelled by a user.

11. A gliding object as defined in claim 10, wherein at least one of said wheel members of the rolling units is banked in an inclined position by said adjustment means to define a gliding path over which said gliding object will travel when propelled by a user.

12. A gliding object as defined in claim 10, wherein three of said rolling units are provided and positioned to be in a three wheel form with said wheel member of one of said rolling units having a center which is disposed laterally by said adjustment means to the right or left side of a center line oriented intermediate the other two of said rolling units and between the front and back ends.

13. A gliding object as defined in claim 10, wherein three of said rolling units are provided and positioned to be in a three wheel form, said wheel member of at least one of said rolling units being pivoted about a vertical axis by said adjustment means to define a starting pitch for said wheel member which is varied to vary a gliding path over which said gliding object will travel when propelled by a user.

14. A gliding object as defined in claim 10, wherein said adjustment means of at least one of said roller members is adapted so that it is possible to bank a tire of the rolling unit about a horizontal axis to either side thereof, to adjust the degree at which the wheel member is moved in a sideways direction, or to vary a rotatable position about a vertical axis of the wheel member to define a starting pitch for the wheel member.

15. A gliding object as defined in claim 10, wherein said cassette is a substantially rectangular sleeve and said respective hollow defines at least one access space adjacent at least one side of said sleeve to access said sleeve.

16. A gliding object as defined in claim 15, wherein said respective hollow defines two of said access spaces disposed adjacent opposite sides of said sleeve.

17. A gliding object as defined in claim 15, wherein said mounting means is provided for detachably engaging said rolling unit with said body and said access spaces provide access to releasably detach said rolling unit from said body.

18. A gliding object as defined in claim 10, wherein said body includes engaging shoulders which are formed in said body within said hollows, said cassettes each having opposing side walls and said wheel member rotatably engaged therein between said side walls, said mounting means comprising elastic engaging strips which are integrally formed with both side walls of said cassettes, said elastic engaging strips including fastening pawls which are formed at an upper portion thereof and are adapted to resiliently engage said engaging shoulders when said rolling unit is inserted within said hollow.

19. The gliding object as defined in claim 10, wherein said cassette has an outer surface and said hollow in said body is defined by an inner surface, said outer and inner surfaces being mutually adjacent when said cassette is received within said hollow, said mounting means comprising a spring biased projection adapted to project from one of said mutually adjacent surfaces and a projection receiving recess in the other of said mutually adjacent surfaces adapted to seat said projection and keep said cassette from falling out of said hollow.

20. The gliding object as defined in claim 1, wherein said mounting means comprises magnet means for magnetically attracting said rolling unit and said body one with the other.

* * * * *

UNITED STATES PATENT AND TRADEMARK OFFICE

CERTIFICATE OF CORRECTION

PATENT NO. : 5 474 293

DATED : December 12, 1995

INVENTOR(S) : Koichi Tanaka

It is certified that error appears in the above-indentified patent and that said Letters Patent is hereby corrected as shown below:

Column 14, line 62; change "claim 1," to
---claim 10,---.

Signed and Sealed this

Second Day of July, 1996

Bruce Lehman

*Attest:*

BRUCE LEHMAN

*Attesting Officer*

*Commissioner of Patents and Trademarks*